US008944587B2

(12) United States Patent
Sugimoto et al.

(10) Patent No.: US 8,944,587 B2
(45) Date of Patent: Feb. 3, 2015

(54) LIQUID EJECTION APPARATUS

(75) Inventors: Kiyoshi Sugimoto, Kuwana (JP); Masayuki Okumura, Nagoya (JP); Shinya Yamamoto, Nagoya (JP); Motohiro Tsuboi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 87 days.

(21) Appl. No.: 13/433,065

(22) Filed: Mar. 28, 2012

(65) Prior Publication Data

US 2013/0027490 A1 Jan. 31, 2013

(30) Foreign Application Priority Data

Jul. 29, 2011 (JP) ..... 2011-167035

(51) Int. Cl.
*B41J 2/01* (2006.01)
*B41J 11/00* (2006.01)
*B41J 13/14* (2006.01)

(52) U.S. Cl.
CPC ..... *B41J 11/006* (2013.01); *B41J 13/14* (2013.01)
USPC ..... 347/104; 347/101

(58) Field of Classification Search
CPC ..... B41J 11/007; B41J 11/06; B41J 11/0085; B41J 13/103; B41J 11/0065
USPC ..... 347/104, 101
See application file for complete search history.

(56) References Cited

U.S. PATENT DOCUMENTS

| | | | | |
|---|---|---|---|---|
| 5,081,472 | A * | 1/1992 | Fisher | 347/33 |
| 6,994,419 | B2 * | 2/2006 | Silverbrook | 347/29 |
| 2008/0246803 | A1 * | 10/2008 | Barger et al. | 347/34 |
| 2009/0200735 | A1 | 8/2009 | Yamamoto | |
| 2009/0219333 | A1 * | 9/2009 | Sakano et al. | 347/22 |
| 2011/0102507 | A1 | 5/2011 | Yamada et al. | |

FOREIGN PATENT DOCUMENTS

| | | | |
|---|---|---|---|
| JP | 2004-074611 | A | 3/2004 |
| JP | 2004-155111 | A | 6/2004 |

(Continued)

OTHER PUBLICATIONS

European Patent Office, Extended European Search Report for European Patent Application No. 12161642.9, mailed Nov. 14, 2013.

*Primary Examiner* — Manish S Shah
*Assistant Examiner* — Yaovi Ameh
(74) *Attorney, Agent, or Firm* — Baker Botts L.L.P.

(57) ABSTRACT

A liquid ejection apparatus includes: a recording portion; a medium-supply portion; a support member for supporting a recording medium while facing the recording portion; a conveyor mechanism including a conveyance guide and a conveyor roller; a first housing accommodating the recording portion; and a second housing accommodating the medium-supply portion, the support member, and the conveyor mechanism. The first housing is pivotable about a pivot shaft with respect to the second housing. The conveyance guide includes a guide portion disposed downstream of the conveyor roller and upstream of the recording portion and having an inclined guide face. The guide portion is opposed to the recording portion in the second direction with a clearance therebetween. The recording portion is configured to pass through a space corresponding to the clearance when the first housing is pivoted between the ejection position and the distant position.

19 Claims, 11 Drawing Sheets

(56) References Cited

FOREIGN PATENT DOCUMENTS

| | | | | |
|---|---|---|---|---|
| JP | 2004-074611 | * 11/2004 | ..... B41J 25/312 | * cited by examiner |
| JP | 2006-051719 | * 2/2006 | | |
| JP | 2006-051719 A | 2/2006 | | |

LIQUID EJECTION APPARATUS

CROSS REFERENCE TO RELATED APPLICATION

The present application claims priority from Japanese Patent Application No. 2011-167035, which was filed on Jul. 29, 2011, the disclosure of which is herein incorporated by reference in its entirety.

BACKGROUND OF THE INVENTION

1. Field of the Invention

The present invention relates to a liquid ejection apparatus including a liquid ejection head for ejecting liquid.

2. Description of the Related Art

There is known a liquid ejection apparatus including a liquid ejection head configured to record an image on a sheet supported by a conveyor belt (a support member). In such a liquid ejection apparatus, a sheet-supply tray can be provided under the conveyor belt. In this configuration, the sheet is conveyed through a curved conveyance path from the sheet-supply tray toward the conveyor belt while being curved.

SUMMARY OF THE INVENTION

In such a liquid ejection apparatus, in order to deal with a sheet jam having occurred between the liquid ejection head and the support member, it is possible to consider forming a space between the liquid ejection head and the support member such that a user can remove the jammed sheet through the space. As one example of such a configuration, it is possible to consider a configuration in which a housing of the apparatus is divided into a first housing accommodating the liquid ejection head and a second housing accommodating the support member, and the first housing is, pivotable with respect to the second housing such that the space between the liquid ejection head and the support member can be exposed.

Where the first housing is pivotable with respect to the second housing, the first housing is moved along an arc path. Thus, in order to prevent components in the first housing from interfering with (contacting) components in the second housing during the movement of the first housing, a clearance through which a component in the first housing is to be moved needs to be formed between the component in the first housing and a component adjacent thereto in the second housing.

However, if the clearance is formed near the conveyance path, the sheet easily enters into the clearance to cause the sheet jam. In particular, where the curved conveyance path through which the sheet is conveyed is formed as in the above-described liquid ejection apparatus, the sheet endeavors to return from its curved state to its original shape. Thus, the sheet easily enters into the clearance, which may cause the sheet jam.

This invention has been developed to provide a liquid ejection apparatus capable of preventing a jam of a recording medium in a configuration in which a first housing is smoothly pivotable with respect to a second housing.

The present invention provides a liquid ejection apparatus, comprising: a recording portion including a liquid ejection head having an ejection face, the liquid ejection head being elongated in a first direction parallel to the ejection face; a supply portion configured to supply a recording medium; a support member configured to support the recording medium while facing the ejection face; a conveyor mechanism including (i) a conveyance guide configured to guide the recording medium and defining a U-shaped curved path extending from the supply portion toward the support member and (ii) a conveyor roller configured to convey the recording medium along the conveyance guide, the conveyor mechanism being configured to convey the recording medium in a second direction parallel to the ejection face and perpendicular to the first direction; a first housing accommodating the recording portion; and a second housing accommodating the supply portion, the support member, and the conveyor mechanism, wherein the first housing is pivotable about a pivot shaft extending along the first direction, between (i) an ejection position at which the recording portion ejects liquid onto the recording medium supported by the support member and (ii) a distant position at which the recording portion is farther from the support member than the recording portion in a situation in which the first housing is located at the ejection position, wherein, when the first housing is located at the ejection position, the pivot shaft is located at a position that is farther from the support member than the ejection face in a third direction perpendicular to the ejection face and that is downstream of the recording portion in the second direction, wherein the conveyance guide includes a guide portion disposed downstream of the conveyor roller and upstream of the recording portion in the second direction, the guide portion having a guide face inclined in a direction directed from the ejection face toward the support member in the third direction toward a downstream side of the guide face in the second direction, the guide portion being configured to guide the recording medium along the guide face, wherein, when the first housing is located at the ejection position, the guide portion is opposed to the recording portion in the second direction with a clearance therebetween, and wherein the recording portion is configured to pass through a space corresponding to the clearance when the first housing is pivoted between the ejection position and the distant position.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIGS. 4A and 4B are views each for explaining a part of the lock mechanism, wherein FIG. 4A shows a rotation inhibited state, and FIG. 4B shows a rotation allowed state;

FIGS. 8A and 8B are elevational views of components around the head in vertical cross section showing a relationship among the components when the upper housing is moved from an ejection position to the distant position, wherein FIG. 8A shows a situation in which the upper housing is located at the ejection position, and FIG. 8B shows a situation just after the upper housing is started to be moved;

FIGS. 9A and 9B are elevational views of the components around the head in vertical cross section showing the relationship among the components when the upper housing is moved from the ejection position to the distant position, wherein FIG. 9A shows a situation in which the upper housing has been moved from its position shown in FIG. 8B, and FIG. 9B shows a situation in which the upper housing has been moved from its position shown in FIG. 9A;

DETAILED DESCRIPTION OF THE EMBODIMENT

Hereinafter, there will be described one embodiment of the present invention by reference to the drawings.

Figure 1:
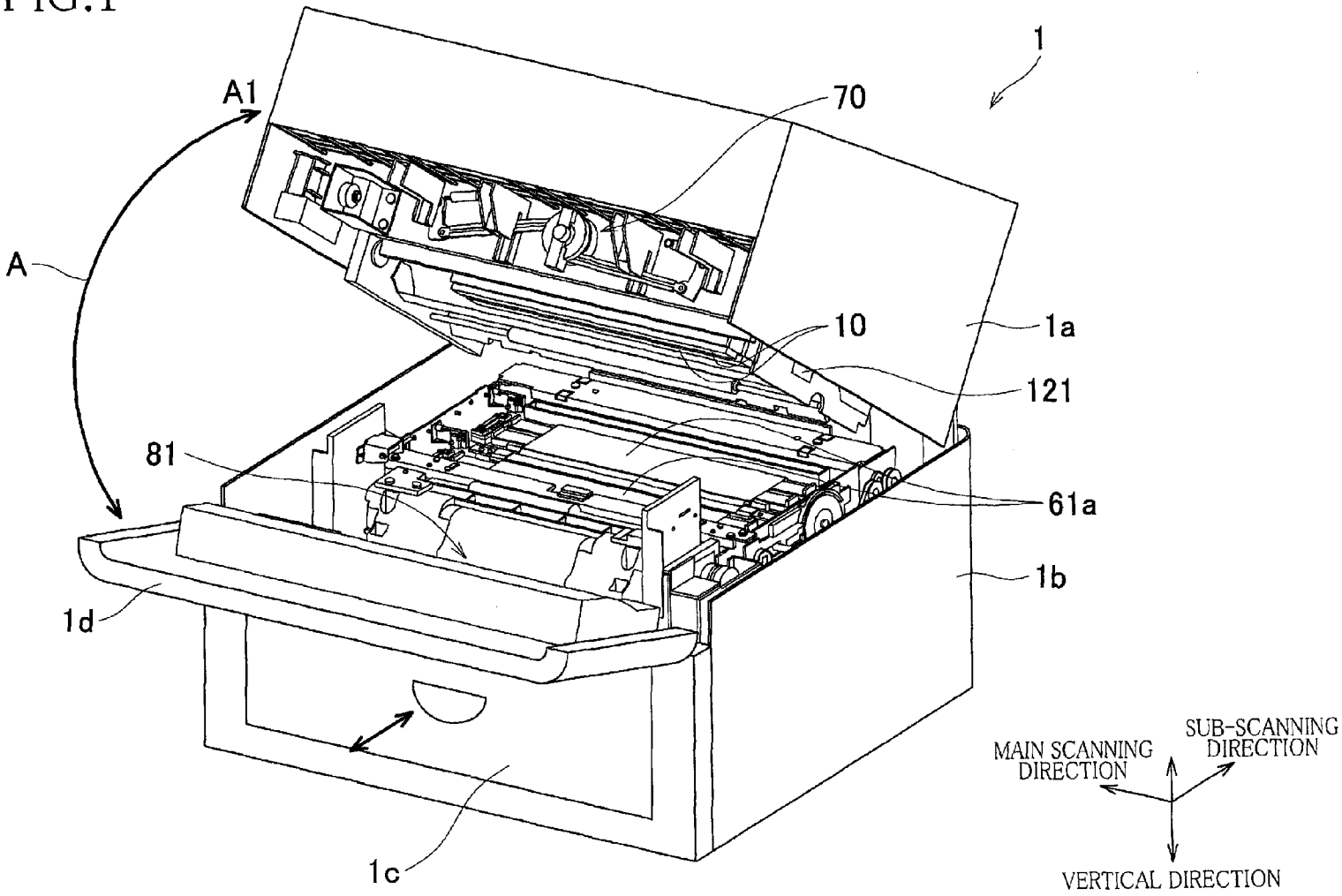
FIG. 1 is an external perspective view showing an ink-jet printer as one embodiment of the present invention.
Figure 2:
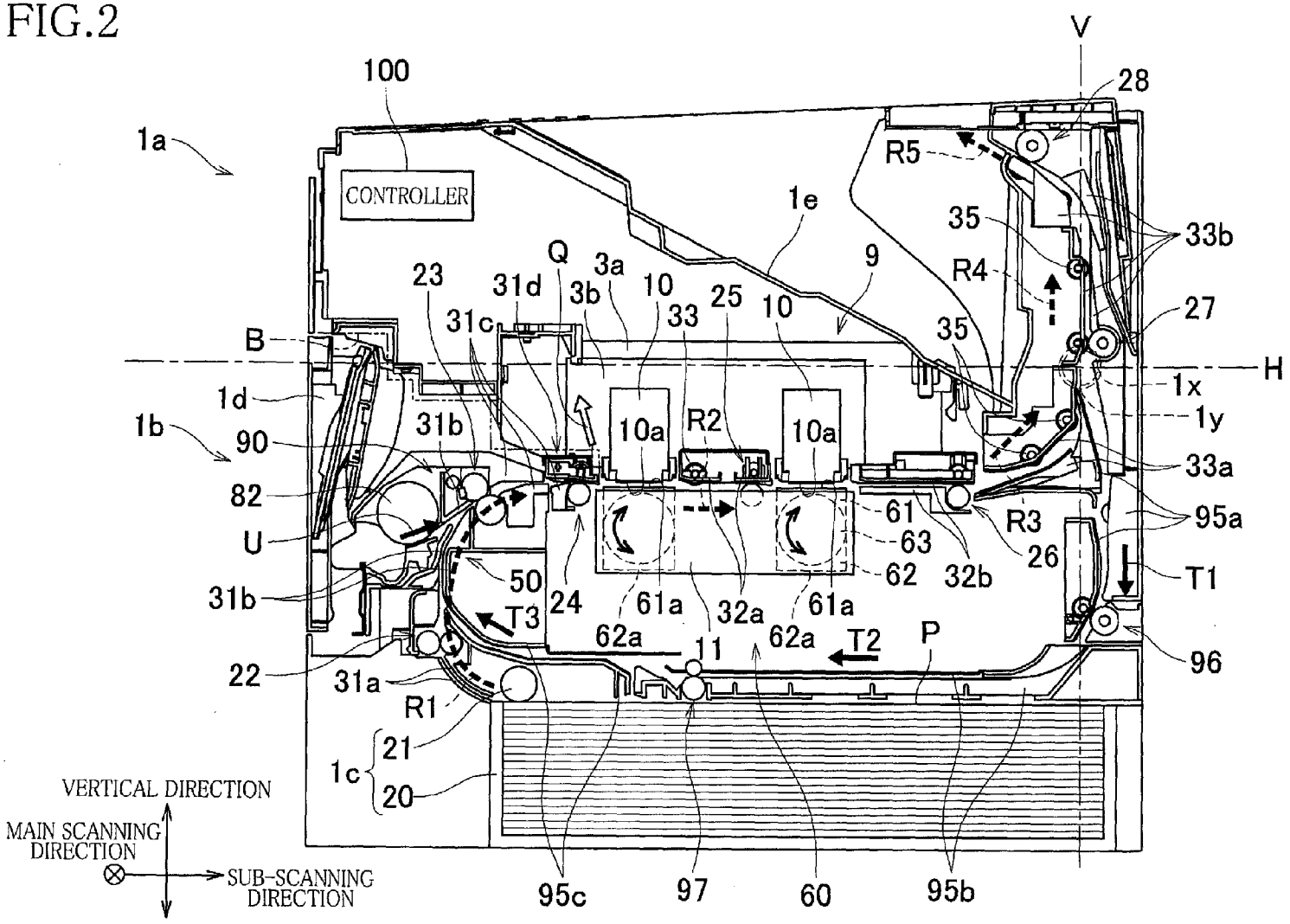
FIG. 2 is a side view generally showing an inside of the printer.

As shown in FIGS. 1 and 2, the printer 1 includes an upper housing 1*a* (as one example of a first housing) and a lower housing 1*b* (as one example of a second housing) each having a rectangular parallelepiped shape and having generally the same size as each other. The upper housing 1*a* opens in its lower face, and the lower housing 1*b* opens in its upper face. As shown in FIG. 2, when the upper housing 1*a* is superposed on the lower housing 1*b* so as to seal the opening faces of the housings 1*a*, 1*b*, a space in the printer 1 is defined. A sheet-discharge portion 1*e* is provided on a top plate of the upper housing 1*a*. In the space defined by the upper and lower housings 1*a*, 1*b* is formed a sheet conveyance path through which a recording medium in the form of a sheet P is conveyed from a sheet-supply unit 1*c* which will be described below toward the sheet-discharge portion 1*e* along bold broken arrows R1-R5 shown in FIG. 2. A controller 100 is provided in the printer 1 for controlling components of the printer 1. A configuration of the controller 100 will be explained later in detail.

It is noted that a direction perpendicular to a sheet face of FIG. 2 and directed from a front side toward a back side of the printer 1 in FIG. 2 is defined as a main scanning direction (as one example of a first direction), a direction perpendicular to the main scanning direction and directed rightward is defined as a sub-scanning direction (as one example of a second direction), and a direction perpendicular to both of the main scanning direction and the sub-scanning direction is defined as a vertical direction (as one example of a third direction).

In the upper housing 1*a*, a pivot shaft 1*x* is provided so as to extend in the main scanning direction. In the lower housing 1*b*, a bearing 1*y* is provided for supporting the pivot shaft 1*x* pivotably or rotatably. As a result, the upper housing 1*a* can be pivoted relative to the lower housing 1*b* about the pivot shaft 1*x* in directions indicated by sign A in FIG. 1. When pivoted, the upper housing 1*a* moves along an arc path, with the pivot shaft 1*x* as a center of the arc. As shown in FIG. 2, the pivot shaft 1*x* and the bearing 1*y* are disposed at their respective positions lower than a center of the upper housing 1*a* in the vertical direction and near an end portion (a right end portion in FIG. 2) of the printer 1 (the upper housing 1*a*) in the sub-scanning direction. These positions are higher than those of ejection faces 10*a* of heads 10 which will be described below (in other words, these positions are more distant from platens 61 than the ejection faces 10*a* in the vertical direction). The upper housing 1*a* pivoted so as to be selectively positioned at one of a position at which the upper housing 1*a* is close to or contacts the lower housing 1*b* (shown in FIG. 2) and a position at which the upper housing 1*a* is more distant from the lower housing 1*b* than the position close to the lower housing 1*b* (shown in FIG. 1). When the upper housing 1*a* is located at the position shown in FIG. 2, liquids such as pretreatment liquid and ink are ejected from the heads 10 which will be described below, and thus the position shown in FIG. 2 is hereinafter referred to as "ejection position". The position shown in FIG. 1 is hereinafter referred to as "distant position".

When the upper housing 1*a* is located at the distant position, the sheet conveyance path is partly exposed to an outside so as to form a work space for a user. When the work space has been formed with the upper housing 1*a* being located at the distant position, the user can perform a jam clearing operation (that is a work for resolving a jam of the sheet P in the sheet conveyance path). Springs, not shown, are provided between the upper housing 1*a* and the lower housing 1*b*. These springs are for urging the upper housing 1*a* in a direction indicated by sign A1 in FIG. 1 (i.e., in a direction from the ejection position toward the distant position). In the present embodiment, the upper housing 1*a* can be opened up to about 35 degrees with respect to a horizontal plane.

A housing-position sensor 121 for detecting a position of the upper housing 1*a* is provided on one of side faces of the upper housing 1*a* (i.e., a front and right side face in FIG. 1). When the upper housing 1*a* is located at the ejection position, the housing-position sensor 121 emits a light to a predetermined area of the lower housing 1*b* and receives a light reflected from the predetermined area to detect that the upper housing 1*a* is located at the ejection position. When the upper housing 1*a* is moved from the ejection position, the emitted light deviates from the predetermined area. Thus, the housing-position sensor 121 does not receive the reflected light and detects that the upper housing 1*a* is not located at the ejection position. The housing-position sensor 121 sends the controller 100 a signal indicating a result of the detection.

Provided in a front portion of the upper housing 1*a* (i.e., a front and left portion in FIG. 1) is a lock mechanism 70 for limiting the pivotal movement of the upper housing 1*a* located at the ejection position. Provided in a front portion of the lower housing 1*b* is an openable and closable panel 1*d* for covering a front face of the upper housing 1*a*. When the upper housing 1*a* is located at the ejection position, the panel 1*d* is opened to expose the lock mechanism 70 to an outside of the printer 1. This enables the user to operate the lock mechanism 70. When the upper housing 1*a* is pivoted from the ejection position to the distant position, the user opens the panel 1*d*, then releases a lock or limitation by the lock mechanism 70, and then pivots the upper housing 1*a*. On the other hand, when the upper housing 1*a* is pivoted from the distant position to the ejection position, the user moves the upper housing 1*a* from the distant position to the ejection position, then limits the pivotal movement of the upper housing 1*a* by the lock mechanism 70, and then closes the panel 1*d*.

There will be next explained a structure of the lock mechanism 70 with reference to FIGS. 3A-4B. The lock mechanism 70 includes: a rotational member 71 having a circular cylindrical shape; interlocked members 73*a*, 73*b*; pivot members 74*a*, 74*b*; springs 76*a*, 76*b*; fixed members 75*a*, 75*b*; shaft members 75*c*, 75*d*; a lever 83; and a solenoid 84. The rotational member 71, the interlocked members 73*a*, 73*b*, the pivot members 74*a*, 74*b*, and the springs 76*a*, 76*b* are accommodated and held in the upper housing 1*a*. The fixed members 75*a*, 75*b* and the shaft members 75*c*, 75*d* are accommodated and held in the lower housing 1*b*. One end of each of the interlocked members 73*a*, 73*b* in its longitudinal direction is connected to an outer circumferential face of the rotational member 71. Each of the pivot members 74*a*, 74*b* is connected to the other end of a corresponding one of the interlocked members 73*a*, 73*b* in its longitudinal direction. The pivot members 74*a*, 74*b* respectively have recessed portions 74*c*, 74*d* engageable with the respective shaft members 75*c*, 75*d*. Each of the springs 76*a*, 76*b* is connected at one end thereof to an upper end of a corresponding one of the pivot members 74*a*, 74*b* and is fixed at the other end thereof to the upper housing 1*a*. Each of the fixed members 75*a*, 75*b* projects from the lower housing 1*b* toward the rotational member 71. Each of the shaft members 75*c*, 75*d* extends in the sub-scanning direction and fixed to a corresponding one of the fixed members 75*a*, 75*b* so as to be engageable with the corresponding one of the recessed portions 74*c*, 74*d*.

A handle or lever 72 having a rod-like shape is fixed to a front face of the rotational member 71. A button 72*b* that can be pushed by the user is provided at a rotational center of the handle 72. Further, the solenoid 84 for inhibiting the rotation of the handle 72 is provided.

Each of the springs 76*a*, 76*b* urges the upper end of the corresponding one of the pivot members 74*a*, 74*b* in a direction directed toward the rotational member 71. As a result, as shown in FIG. 3A, in a situation in which an external force is not applied, the portions of the lock mechanism 70 are at rest in a state in which the handle 72 extends in the vertical direction.

Figure 4A:
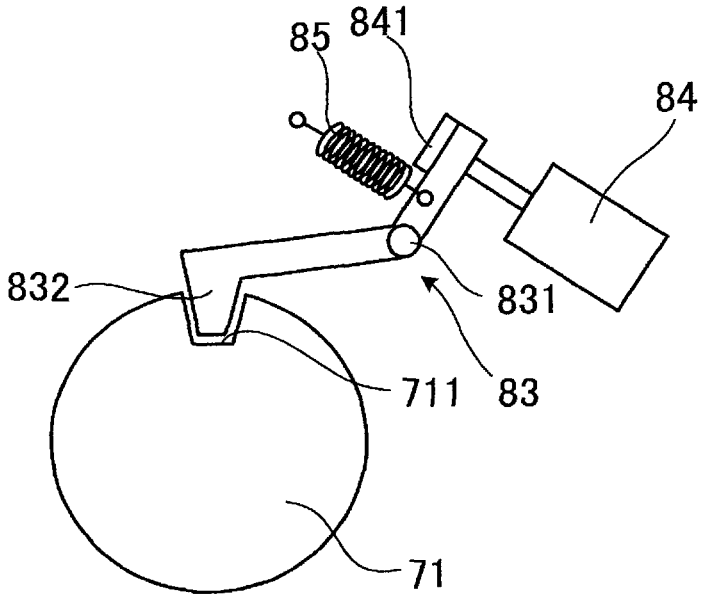
Figure 4B:
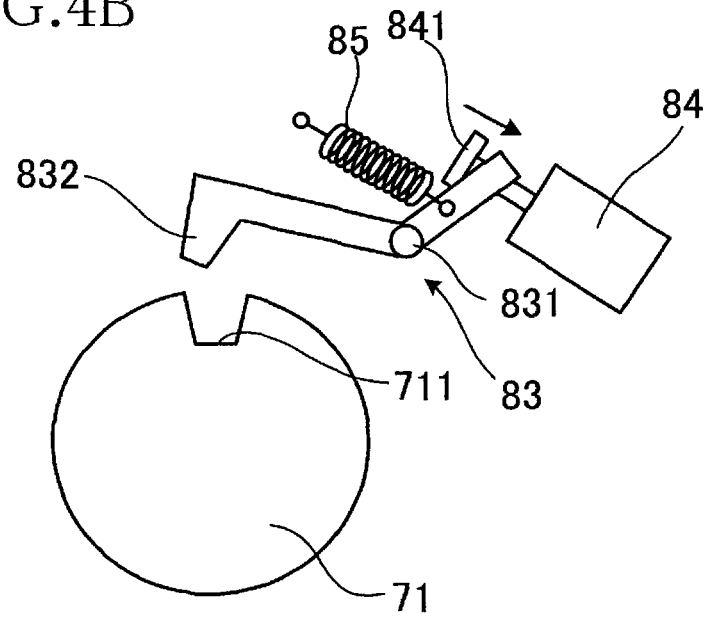

As shown in FIG. 4A, the rotational member 71 has a recessed portion 711 formed therein. The lever 83 and the solenoid 84 are supported next to the rotational member 71 by the upper housing 1*a*. The lever 83 is pivotable about a support shaft 831 between a position shown in FIG. 4A and a position shown in FIG. 4B. When the lever 83 is located at the position shown in FIG. 4A, a projecting portion 832 formed at one end portion of the lever 83 is engaged with the recessed portion 711 of the rotational member 71. The other end portion of the lever 83 is connected to an arm 841 of the solenoid 84. When driven by a lock control section 106 (see FIG. 10), the solenoid 84 draws the arm 841 as shown in FIG. 4B. On the other hand, when not driven by the lock control section 106, the solenoid 84 does not draw the arm 841 as shown in FIG. 4A. Further, the other end portion of the lever 83 is connected to a spring 85. This spring 85 urges the lever 83 in such a direction that the projecting portion 832 of the lever 83 moves toward the recessed portion 711 of the rotational member 71. That is, when the solenoid 84 is not driven by the lock control section 106, the lever 83 is urged by the spring 85 such that the projecting portion 832 of the lever 83 moves toward the recessed portion 711 of the rotational member 71. Here, a state shown in FIG. 4A is a rotation inhibited state, and a state shown in FIG. 4B is a rotation allowed state. In the case of the rotation inhibited state, the recessed portion 711 and the projecting portion 832 are engaged with each other. Thus, even if the user applies a force to rotate or pivot the handle 72, the rotational member 71 is not rotated, and thus the handle 72 is not rotated. On the other hand, in the case of the rotation allowed state, the projecting portion 832 of the arm 841 and the recessed portion 711 of the rotational member 71 are not engaged with each other. Thus, when the user applies a force to rotate or pivot the handle 72, the rotational member 71 is pivoted, and thus the handle 72 is pivoted.

The handle 72 is usually in the rotation inhibited state shown in FIG. 4A. When the solenoid 84 is driven by the lock control section 106, the handle 72 is changed from the rotation inhibited state to the rotation allowed state shown in FIG. 4B. For example, when the user has pushed the button 72*b* to perform the jam clearing operation or the like, a limitation release signal indicating that the lock by the lock mechanism 70 is to be released is outputted to the controller 100 from a button sensor 86 provided in the button 72*b*. That is, when the button 72*b* has been pushed, the button sensor 86 outputs a detection signal (i.e., the limitation release signal) to the controller 100. When having received the limitation release signal, the controller 100 drives the solenoid 84. As a result, the handle 72 is changed from the rotation inhibited state to the rotation allowed state.

Figure 3A:
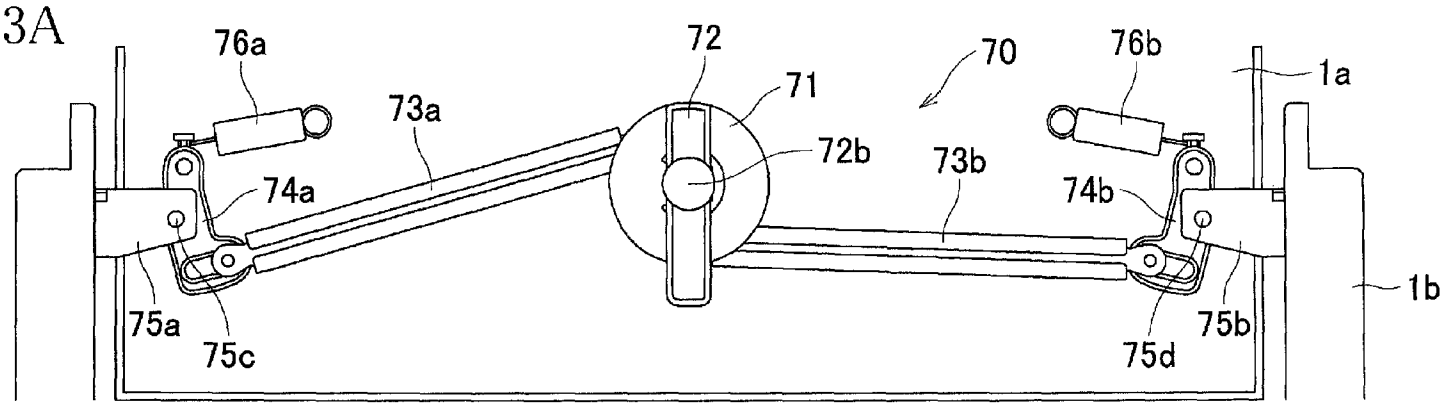
FIGS. 3A and 3B are front elevational views each partly showing a lock mechanism.

When the lock mechanism 70 is in the state shown in FIG. 3A, the respective recessed portions 74*c*, 74*d* of the pivot members 74*a*, 74*b* are engaged with the shaft members 75*c*, 75*d*, respectively. These engagements limit the movement of the upper housing 1*a* such that the upper housing 1*a* located at the ejection position does not pivot toward the distant position.

Figure 3B:
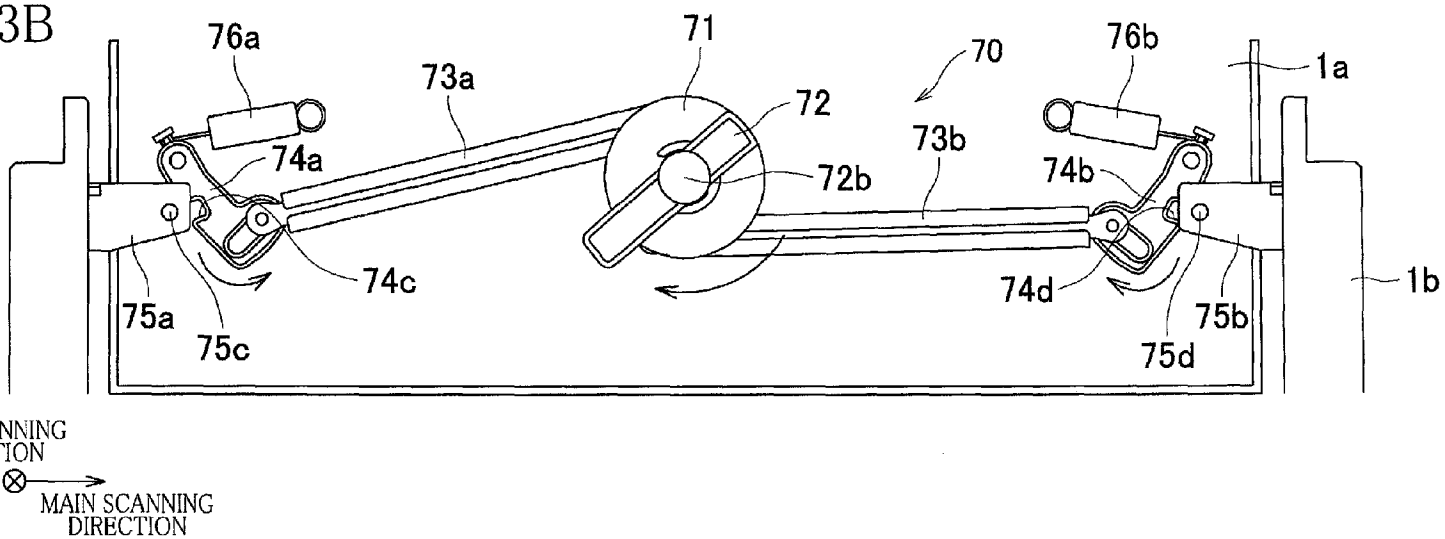

When the user rotates the handle 72 in the rotation allowed state in a clockwise direction against the urging forces of the springs 76*a*, 76*b*, the interlocked members 73*a*, 73*b* are moved as shown in FIG. 3B. When the interlocked members 73*a*, 73*b* are moved, the pivot members 74*a*, 74*b* are pivoted such that the respective recessed portions 74*c*, 74*d* of the pivot members 74*a*, 74*b* are disengaged from the shaft members 75*c*, 75*d*, respectively. As a result, the above-described engagements are released (that is, the limitation of the movement of the upper housing 1*a* located at the ejection position is released), making it possible for the user to manually move the upper housing 1*a* from the ejection position to the distant position. When the upper housing 1*a* starts to move away from the ejection position, the controller 100 based on the detection signal of the housing-position sensor 121 judges that the upper housing 1*a* has been moved away from the ejection position. When the controller 100 judges that the upper housing 1*a* is distant from the ejection position, the lock control section 106 stops driving the solenoid 84.

When the user manually returns the upper housing 1*a* from the distant position to the ejection position, the respective recessed portions 74*c*, 74*d* of the pivot members 74*a*, 74*b* are automatically engaged with the shaft members 75*c*, 75*d* by the urging forces of the springs 76*a*, 76*b*, respectively. When the upper housing 1*a* has been returned to the ejection position, the controller 100 based on the detection signal of the housing-position sensor 121 judges that the upper housing 1*a* has been returned from the distant position to the ejection position. It is noted that the respective recessed portions 74*c*, 74*d* of the pivot members 74*a*, 74*b* have been engaged respectively with the shaft members 75*c*, 75*d* again at this point in time. Further, the projecting portion 832 of the lever 83 has also been engaged again with the recessed portion 711 of the rotational member 71. The handle 72 is changed to the rotation inhibited state. As a result, the lock mechanism 70 starts to limit the movement of the upper housing 1*a* to the distant position.

In the upper housing 1*a* and the lower housing 1*b*, components described below are arranged near the sheet conveyance path formed when the upper housing 1*a* is located at the ejection position. As shown in FIG. 2, a head unit 9 is accommodated in a central portion of the printer 1 in the vertical direction and the sub-scanning direction. The head unit 9 includes: the two heads 10 (as one example of a liquid ejection head) for ejecting the liquid; a main carriage 3*a* and a sub-carriage 3*b* for supporting the heads 10; and cap members 40 (each as one example of an annular member). The heads 10 are fixed to the sub-carriage 3*b* so as to be spaced apart from each other in the sub-scanning direction at a predetermined distance therebetween. An upstream one of the heads 10 in the sub-scanning direction is configured to eject the pretreatment liquid, and a downstream one of the heads 10 is configured to eject black ink. The sub-carriage 3*b* is supported by the upper housing 1*a* via the main carriage 3*a*. The main carriage 3*a* supports the sub-carriage 3*b* such that the sub-carriage 3*b* can be reciprocated in the vertical direction. The main carriage 3*a* includes a carriage moving mechanism 3*c* (see FIG. 10) for moving the sub-carriage 3*b* in the vertical direction.

Each of the heads 10 is a line head elongated in the main scanning direction and having a generally rectangular parallelepiped shape as its outer shape. The two heads 10 have the same structure, and thus the following explanation will be given for one of the heads 10 for the sake of simplicity unless otherwise required by context. A joint to which a tube is to be connected is provided on an upper face of the head 10, and a multiplicity of ejection openings are formed in a lower face of the head 10 as the ejection face 10*a*. The liquid is supplied through the tube from an ink cartridge accommodated in the printer 1. The head 10 has channels formed therein for supplying the liquid having flowed from the joint into the head 10, to the respective ejection openings. The ejection face 10*a* is a flat face expanding along both of the main scanning direction and the sub-scanning direction. The ejection face 10*a* is disposed below the height level of the pivot shaft 1*x*.

As shown in FIG. 2, a support portion 60 is provided under the head unit 9. The support portion 60 is disposed so as to face the ejection faces 10*a* in the vertical direction. As shown in FIG. 2, the support portion 60 includes: two rotors 63 opposite the respective heads 10; the two platens 61 (each as one example of a support member) and two facing member 62 each fixed to an outer circumferential face of a corresponding one of the rotors 63; and a frame 11 supporting the two rotors 63 rotatably. The support portion 60 includes a rotor pivoting mechanism 60*a* (see FIG. 10) for pivoting or rotating each of the rotors 63 about a corresponding one of rotation shafts each extending in the main scanning direction.

For each head 10, each of the platen 61 and the facing member 62 is one size larger than the ejection face 10*a* in the main scanning direction and the sub-scanning direction, and the platen 61 and the facing member 62 are disposed so as to be opposed to each other in the vertical direction.

A face of the platen 61 is a support face 61*a* for supporting the sheet P while facing the ejection face 10*a*. A material and a processing for the support face 61*a* are selected and employed so as to reliably hold the sheet P. For example, a silicon layer having a low viscosity is formed on the support face 61*a*, and a multiplicity of ribs are formed on the support face 61*a* in the sub-scanning direction, preventing floating and the like of the sheet P placed on the support face 61*a*. The platen 61 is formed of a resin material.

The facing member 62 is formed of a material having a property of not or hardly permeating or sucking water therein. For example, the facing members 62 are formed of a metal or a glass. A face of the facing member 62 is a smooth and flat facing face 62*a* that can face the ejection face 10*a*.

When rotated, the rotor 63 is changed between (a) a first state (see FIGS. 1, 2, and 7-9) in which the support face 61*a* faces the ejection face 10*a*, and the facing face 62*a* does not face the ejection face 10*a* and (b) a second state (see FIG. 5B) in which the support face 61*a* does not face the ejection face 10*a*, and the facing face 62*a* faces the ejection face 10*a*. In the present embodiment, the controller 100 is configured to control the rotor 63 such that the first state is established when the liquid is ejected from the ejection openings onto the sheet P to record an image (which will be described below) and such that the second state is established when the ejection face 10*a* is sealed by the cap member 40 (which will be described below). When rotating the rotor 63, the controller 100 first controls the carriage moving mechanism 3*c* to raise the sub-carriage 3*b* for retracting the ejection face 10*a* such that the ejection face 10*a* does not interfere with the rotation (pivotal movement) of the rotor 63. The controller 100 then controls the rotor pivoting mechanism 60*a* to pivot the rotor 63 and then controls the carriage moving mechanism 3*c* to lower the sub-carriage 3*b* to return the ejection face 10*a* to its original position.

Figure 5A:
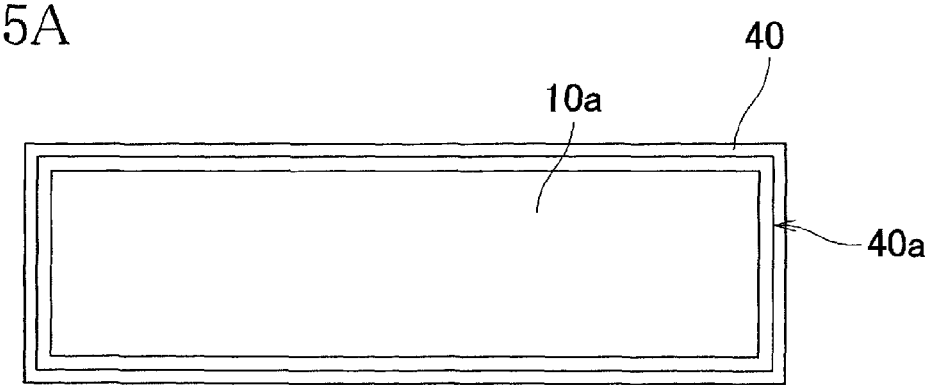
FIG. 5A is a bottom view showing an annular member and a head.

The head unit 9 includes the cap members 40 (the annular members) each for enclosing outer faces of a lower end portion of a corresponding one of the heads 10. Each of the cap members 40 is provided along faces (side faces) 10*b* of the corresponding head 10 which extend in a direction (the vertical direction) perpendicular to the ejection face 10*a* of the head 10. The cap member 40 is formed of an elastic material such as a rubber, and as shown in FIG. 5A, has an annular shape enclosing outer edges of the ejection face 10*a* in plan view. The cap member 40 has a projecting portion 40*a* at a lower end portion thereof and having an inverted triangle shape in cross section.

Figure 5B:
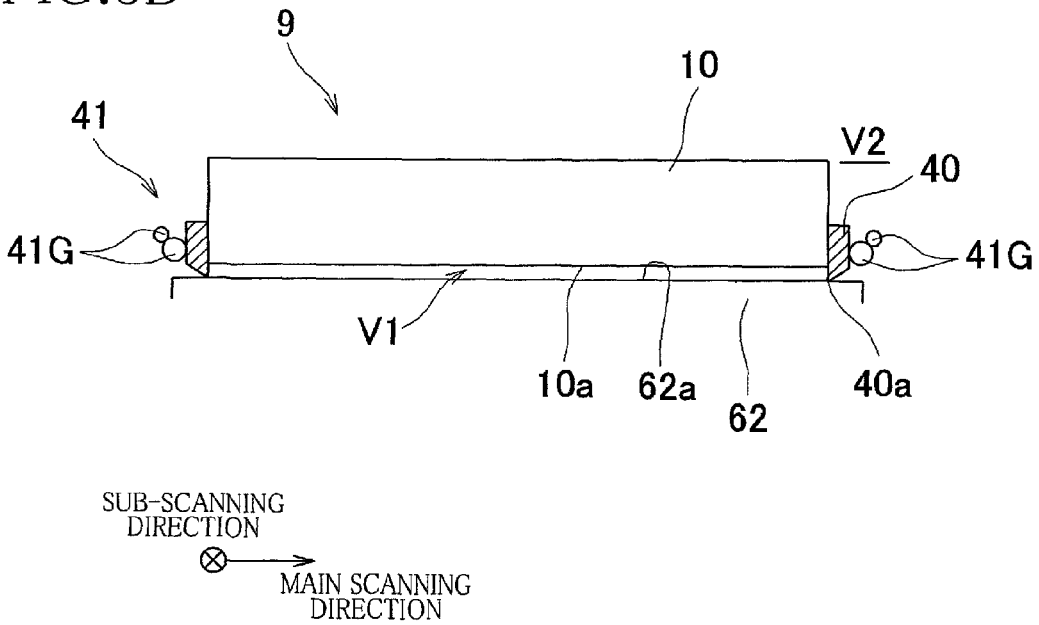
FIG. 5B is a front elevational view showing the annular member, the head, and a facing member.

As shown in FIG. 5B, the cap member 40 is selectively moved upward or downward by a cap moving mechanism 41 (as one example of a moving mechanism). The cap moving mechanism 41 includes a plurality of gears 41G and a drive motor, not shown, for driving these gears 41G. When the gears 41G are driven, the cap member 40 is moved upward or downward in the vertical direction. When the upper housing 1*a* is located at the ejection position, the cap member 40 is selectively moved upward or downward and can be located at one of (i) an upper position (an open position) shown in FIGS. 7 and 8A-8D at which the projecting portion 40*a* is located at a position higher in height than that of the ejection face 10*a* and (ii) a lower position (a sealing position) shown in FIG. 5B at which the projecting portion 40*a* is located at a position lower in height than that of the ejection face 10*a* and is held in contact with the facing face 62*a*. A maximum distance of the upward or downward movement of the, cap member 40 is a distance in which the cap member 40 can be brought into contact with the facing face 62*a* when the upper housing 1*a* is located at the ejection position.

Figure 8A:
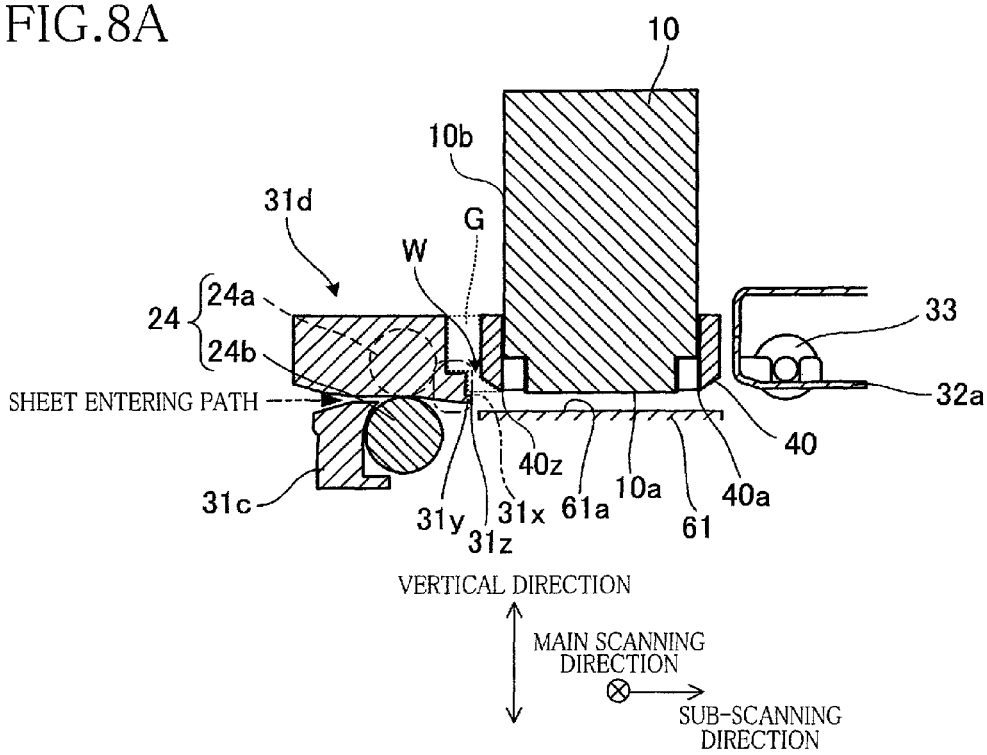

As shown in FIG. 5B, when the cap member 40 is located at the lower position and held in contact with the facing face 62*a*, the ejection face 10*a* is sealed by a contact of a distal end of the projecting portion 40*a* with the facing face 62*a*. That is, an ejection space V1 formed between the ejection face 10*a* and the facing face 62*a* is isolated from an outside space V2. This suppresses drying of the liquid near the ejection openings of the ejection face 10*a*. It is noted that, as shown in FIG. 8A, when the cap member 40 is located at the open position, a lower end 40*z* of the projecting portion 40*a* (that is one of opposite end portions of the cap member 40 which is nearer to the platen 61 than the other in the vertical direction) is located at a position higher than that of each of the ejection face 10*a* and a lower end 31*z* of a rib 31*y* which will be described below (the lower end 31*z* is a part of one of opposite end portions of the conveyance guide 31*d* which is nearer to the platen 61 than the other in the vertical direction).

As shown in FIG. 2, a lowermost portion of the lower housing 1*b* accommodates the sheet-supply unit 1*c* for supplying the sheet P toward the support portion 60. The sheet-supply unit 1*c* includes a sheet-supply tray 20, a sheet-supply roller 21, and a drive motor for driving the sheet-supply roller 21. The sheet-supply tray 20 is mountable in and removable from the lower housing 1*b* from and to a left side thereof in FIG. 2 in the sub-scanning direction. The sheet-supply tray 20 has a box-like shape opening upward and can accommodate various sizes of sheets P. The sheet-supply roller 21 supplies an uppermost one of the sheets P in the sheet-supply tray 20 toward a left side thereof in FIG. 2.

Figure 7:
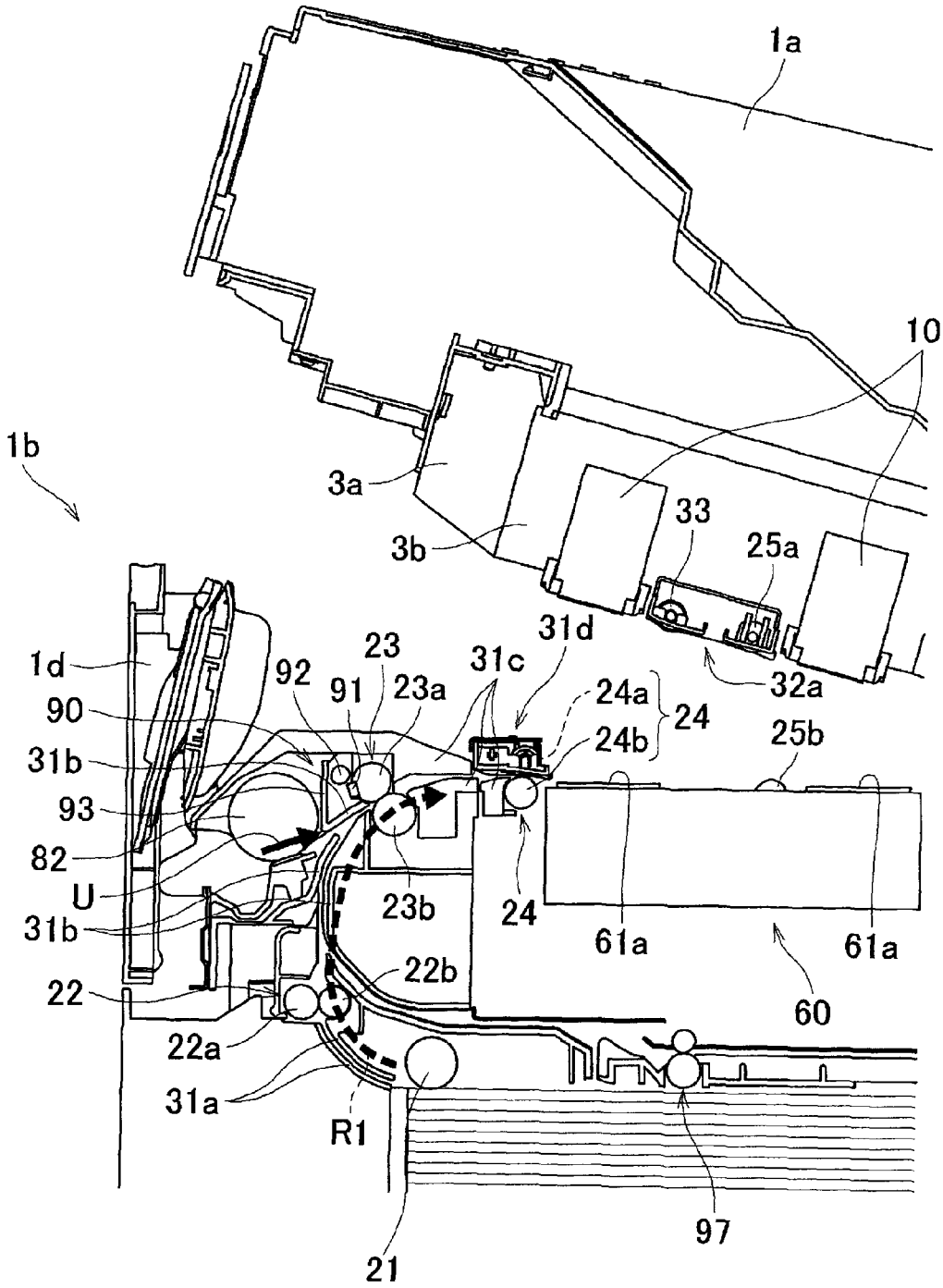
FIG. 7 is a side view generally showing an inside of the printer when an upper housing is located at a distant position.

The sheet P supplied from the sheet-supply roller 21 is conveyed to the support portion 60 along a conveyance path indicated by the arrow R1. As shown in FIG. 7, a conveyor mechanism 50 includes conveyance guides 31*a*, a conveyor roller pair 22, a conveyance guides 31*b*, a conveyor roller pair 23, a paper-dust removing unit 90, and a conveyance guides 31*c*. These components are arranged along the conveyance path in this order from an upstream side to a downstream side in a direction indicated by the arrow R1. The conveyor mechanism 50 further includes a drive motor for driving the conveyor roller pairs. The path along the arrow R1 extends upward and curves so as to have a U-shape projecting to an outside (a left side in FIG. 2) of the lower housing 1*b* in the sub-scanning direction. This path may be hereinafter referred to as "curved path R1". The conveyance guides 31*a*-31*c* define the curved path R1 and guide the sheet P along this curved path R1.

The conveyor roller pair 22 is provided between the conveyance guides 31*a* and the conveyance guides 31*b*, and the conveyor roller pair 23 is provided between the conveyance guides 31*b* and the conveyance guides 31*c*. The conveyor roller pair 22 includes a driven roller 22*a* and a drive roller 22*b*. The conveyor roller pair 23 includes a driven roller 23*a* and a drive roller 23*b*. The driven rollers 22*a*, 23*a* are disposed outside the curved path R1. The drive rollers 22*b*, 23*b* are disposed inside the curved path R1. The drive rollers 22*b*, 23*b* are driven by the drive motor. Each of the driven rollers 22*a*, 23*a* is rotated by the rotation of a corresponding one of the drive rollers 22*b*, 23*b*. The conveyor roller pair 22 conveys the sheet P supplied from the sheet-supply roller 21, to the conveyor roller pair 23 along the conveyance guides 31*a*, 31*b* while nipping the sheet P between the driven roller 22*a* and the drive roller 22*b*. The conveyor roller pair 23 conveys the sheet P conveyed from the conveyor roller pair 22, to a register roller pair 24 (which will be described below) along the conveyance guides 31*b*, 31*c* while nipping the sheet P between the driven roller 23*a* and the drive roller 23*b*.

As shown in FIG. 7, the paper-dust removing unit 90 as one example of a foreign-matter remover is provided near the conveyor roller pair 23. The paper-dust removing unit 90 includes a sponge member 91, an auger member 92, and a chute member 93 for receiving paper dust (foreign matters). The sponge member 91 is held in contact with an outer face of the driven roller 23*a*. The outer face of the driven roller 23*a* is preferably covered with fluoropolymers (a fluororesin), for example, for easy accumulation of electric charge. When the conveyor roller pair 23 is rotated, the driven roller 23*a* and the sponge member 91 rub against each other, whereby the driven roller 23*a* is charged. As a result, the paper dust existing on the sheet P is attracted to the driven roller 23*a*. The paper dust attracted to the driven roller 23*a* is scraped by the sponge member 91 from the roller face into the chute member 93. It is noted that a lower face of the chute member 93 faces the curved path R1 and guides the sheet P conveyed from the conveyor roller pair 22, to the register roller pair 24 which will be described below. That is, the chute member 93 also functions as a part of the conveyance guides 31*c*.

Figure 6:
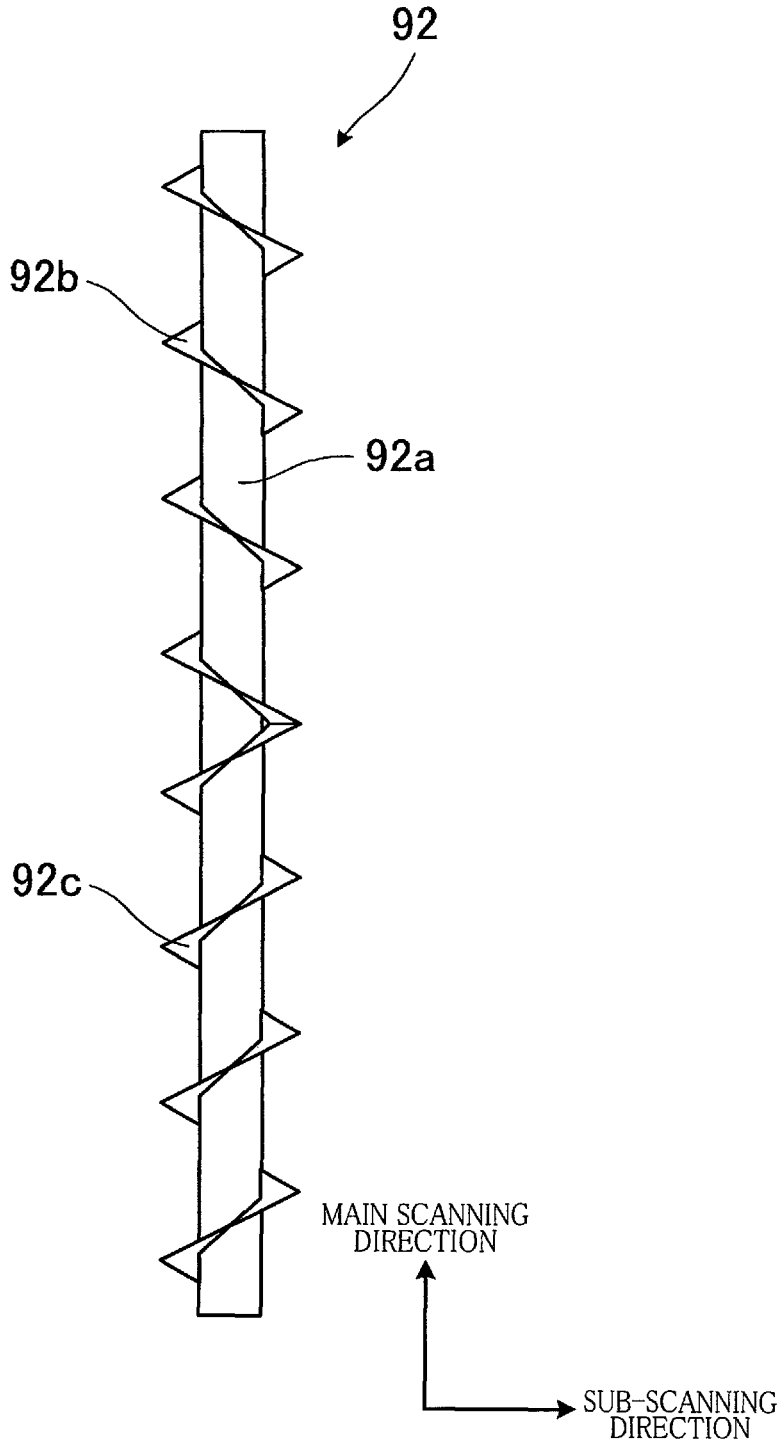
FIG. 6 is a plan view showing an auger member provided in a paper-dust removing unit.

The auger member 92 is disposed on an upper portion of the chute member 93. As shown in FIG. 6, the auger member 92 includes: a rotation shaft 92*a* having a circular cylindrical shape extending in the main scanning direction; and flightings 92*b*, 92*c* projecting from a face of the rotation shaft 92*a* in its radial direction. The helical flighting 92*b* is wrapped around the rotation shaft 92*a* so as to continuously extend from a central portion of the rotation shaft 92*a* to one end thereof in the main scanning direction. The helical fighting 92*c* is wrapped around the rotation shaft 92*a* so as to continuously extend from a central portion of the rotation shaft 92*a* to the other end thereof in the main scanning direction. A direction in which the helical flighting 92*c* extends helically is opposite a direction in which the helical fighting 92*b* extends helically. When the rotation shaft 92*a* is rotated, the flightings 92*b*, 92*c* cause the paper dust accumulated in the chute member 93 to move out of the chute member 93 to its opposite sides in the main scanning direction.

As shown in FIGS. 7 and 8A, the conveyor mechanism 50 further includes a conveyance guide 31*d* (as one example of a guide portion) and the register roller pair 24. The register roller pair 24 includes a driven roller 24*a* (as one example of a conveyor roller) and a drive roller 24*b*. The driven roller 24*a* is rotatably supported by the conveyance guide 31*d*. The drive roller 24*b* is driven by the motor. The driven roller 24*a* is rotated by the rotation of the drive roller 24*b*. The drive roller 24*b* is a conveyor roller nearest to the support portion 60 among the components disposed in an upstream part of the conveyance path, which part is located upstream of the support portion 60. The register roller pair 24 nips a leading edge of the sheet P conveyed by the conveyor roller pair 23 for a predetermined registering time in a state in which the register roller pair 24 is not rotated. As a result, skew (oblique conveyance) of the sheet P is corrected in the state in which the leading edge of the sheet P is nipped by the register roller pair 24. Hereinafter, the operation of the register roller pair 24 for correcting the skew of the sheet P will be referred to as "skew correction". After the predetermined registering time has passed, the register roller pair 24 is rotated to convey in the sub-scanning direction the sheet P whose skew has been corrected.

As shown in FIG. 8A, an upstream part of a lower face of the conveyance guide 31*d* in the sub-scanning direction guides the sheet P conveyed from the conveyor roller pair 23, toward the register roller pair 24 in the sub-scanning direction. The conveyance guide 31*d* includes a projecting portion 31*x* provided at a downstream end portion of a lower end portion of the conveyance guide 31*d* and projecting toward a downstream side thereof in the sub-scanning direction. The downstream end portion is one of opposite end portions of the lower end portion in the sub-scanning direction and is located nearer to the support portion 60 than the other of the opposite end portions. The rib 31*y* is formed on the lower end of the projecting portion 31*x* so as to project toward a downstream side thereof. The projecting portion 31*x* is formed downstream of the register roller pair 24 and upstream of the head unit 9 in the sub-scanning direction.

Figure 8B:
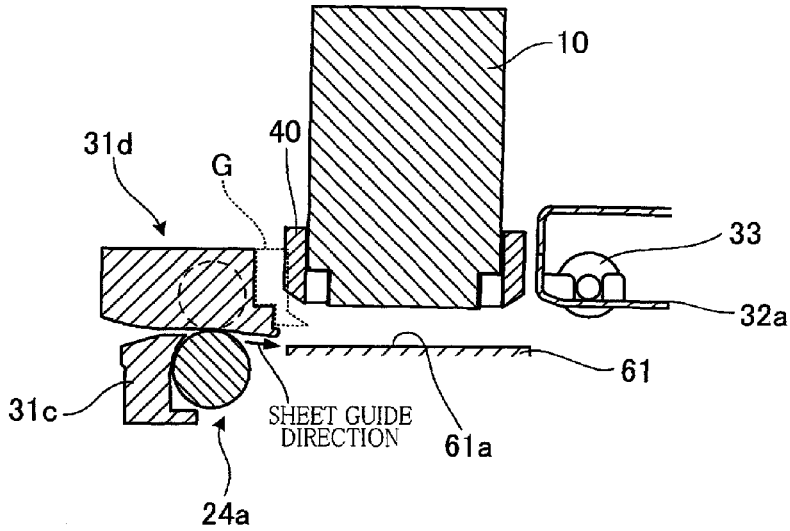

A lower face (as one example of a guide face) of the projecting portion 31*x* is inclined downward toward a downstream side thereof in the sub-scanning direction. In other words, the lower face is inclined downward so as to increase a distance between the lower face and the ejection face 10*a* in the vertical direction and decrease a distance between the lower face and the support face 61*a* of the platen 61 in the vertical direction toward the downstream side in the sub-scanning direction. Specifically, a downstream portion of the lower face in the sub-scanning direction is lower in height than an upstream portion of the lower face in the sub-scanning direction. As shown in FIG. 8B, the sheet P conveyed from the register roller pair 24 in the sub-scanning direction is guided by the lower face of the projecting portion 31*x* so as to travel obliquely downward to the support face 61*a*. While supported on the support face 61*a*, the guided sheet P is conveyed to a position under the upstream head 10 in the sub-scanning direction. It is noted that, as described above, when the cap member 40 is located at the open position, the lower end 40*z* of the cap member 40 is located at the position higher than that of the lower end 31z of the rib 31y. Thus, it is possible to prevent the sheet P having passed through the rib 31y from being caught or stuck by the cap member 40. Further, as shown in 8A, the lower end 31z that is the part of the one of the opposite end portions of the conveyance guide 31d which is nearer to the platen 61 than the other in the vertical direction is located at a position nearer to the platen 61 than the ejection face 10a in the vertical direction. Also in this configuration, it is possible to prevent the sheet having passed through the rib 31y from being brought into contact with the ejection face 10a.

As shown in FIG. 2, provided around the head unit 9 are: conveyance guides 32a, 32b for guiding the sheet P in the sub-scanning direction; conveyor roller pairs 25, 26 for conveying the sheet P along the conveyance guides 32a, 32b; and a pressure roller 33 for pressing the sheet P from an upper side thereof. The conveyance guides 32a, the conveyor roller pair 25, and the pressure roller 33 are disposed between the two heads 10. The conveyance guides 32b and the conveyor roller pair 26 are disposed downstream of the downstream head 10. The sheet P conveyed by the register roller pair 24 passes through the position under the upstream head 10 and is conveyed to the downstream head 10 by the conveyor roller pair 25 while guided by the conveyance guides 32a. The sheet P having passed through a position under the downstream head 10 conveyed toward a downstream side thereof by the conveyor roller pair 26 while guided by the conveyance guides 32b.

A conveyance path along the arrows R3-R5 is formed so as to extend from the conveyor roller pair 26 to an upper end of the sheet-discharge portion 1e. This conveyance path extends upward from the conveyor roller pair 26 and curves so as to have a U-shape projecting to an outside (a right side in FIG. 2) of the upper housing 1a in the sub-scanning direction. In this conveyance path are provided conveyance guides 33a, a conveyor roller pair 27, conveyance guides 33b, and a conveyor roller pair 28 in this order from an upstream side toward a downstream side in a direction indicated by the arrows R3-R5. A plurality of pressure rollers 35 for pressing the sheet P from an inside of the curved path are provided between the conveyor roller pairs 26, 27 and between the conveyor roller pairs 27, 28. The conveyance guides 33a, 33b guide the sheet P along the curved path. The conveyor roller pairs 27, 28 convey the sheet P along the conveyance guides 33a, 33b and discharges the sheet P onto the sheet-discharge portion 1e.

As thus described, in the printer 1 is formed the conveyance path extending from the sheet-supply unit 1c to the sheet-discharge portion 1e along the arrows R1-R5. As shown in FIG. 2, this conveyance path has a generally inverted S-shape. Specifically, this conveyance path extends leftward from the sheet-supply unit 1c, then curves so as to make the upward U-turn, then extends rightward between the heads 10 and the support portion 60, then curves in a right end portion of the printer 1 so as to make the upward U-turn, and finally extends leftward to the sheet-discharge portion 1e in an upper end portion of the printer 1.

In the printer 1, a reconveyance path (third path) and a manual conveyance path (second path) are formed each as a conveyance path different from the conveyance path (first path) extending along the arrows R1-R5. The reconveyance path is a path in which the sheet P conveyed along the arrows R1-R4 and having reached the conveyor roller pair 28 is conveyed backward (returned) without being discharged onto the sheet-discharge portion 1e and then is conveyed toward the position upstream of the support portion 60 along arrows T1-T3. In this reconveyance path are provided a conveyance guides 95a, a conveyor roller pair 96, conveyance guides 95b, a conveyor roller pair 97, and conveyance guides 95c in this order from an upstream side toward a downstream side in a direction indicated by the arrows T1-T3. The conveyor roller pairs 27, 28 are rotatable reversely for allowing the sheet P to be reconveyed in a direction (reverse direction) opposite the direction indicated by the arrows R4, R5.

The sheet P conveyed by the conveyor roller pairs 27, 28 in the reverse direction travels generally downward in the vertical direction along the arrow T1 to the conveyor roller pair 96. The conveyor roller pairs 96, 97 convey the sheet P conveyed by the conveyor roller pairs 27, 28 in the reverse direction, to a middle portion of the curved path R1 along the conveyance guides 95a-95c in the direction indicated by the arrows T1, T2. The conveyed sheet P enters into the curved path R1 from the middle portion and is conveyed toward the conveyor roller pair 23 again. The path from the conveyor roller pair 97 to the conveyor roller pair 23 curves so as to have a U-shape projecting to the outside of the lower housing 1b in the sub-scanning direction. The conveyor roller pair 23 conveys the sheet P toward the support portion 60. As a result, the sheet P is conveyed again to the heads 10 such that a back face of the sheet P faces the ejection faces 10a. It is noted that the back face is reverse to a front face of the sheet P on which the image has been formed.

The manual conveyance path is a path through which a sheet manually fed or supplied is conveyed. When the panel 1d is opened with the printer 1 being in the state shown in FIG. 2, as shown in FIG. 1, an upper face of the opened panel 1d functions as a tray portion 81 for supporting thereon a sheet to be supplied manually from a front side of the printer 1. The sheet P supported on the tray portion 81 is conveyed by a conveyor roller 82 along arrow U in FIG. 2. The sheet P enters into a downstream portion of the curved path R1 and is conveyed toward the conveyor roller pair 23.

Figure 10:
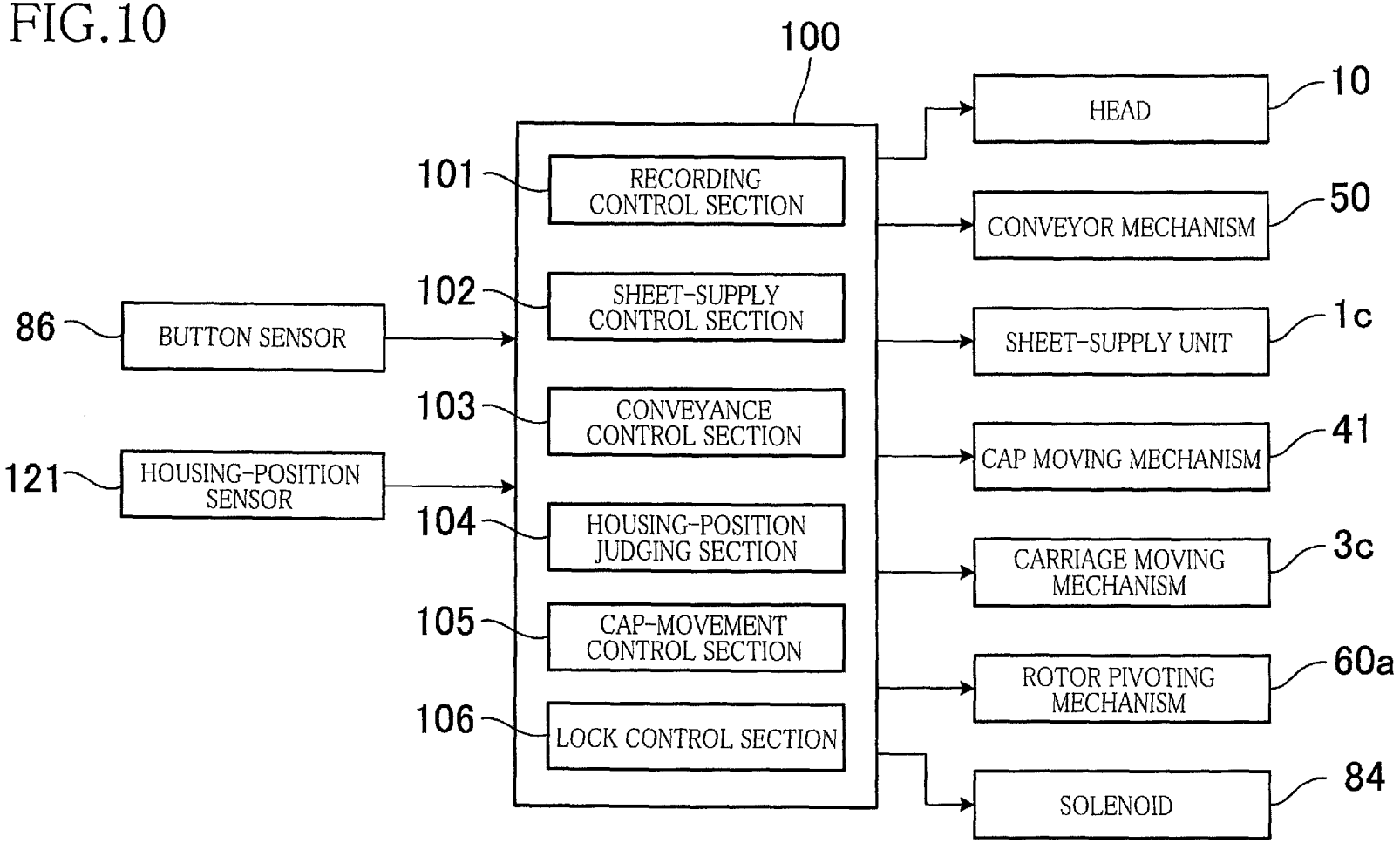
FIG. 10 is a block diagram showing a configuration of a controller.

There will be next explained a configuration of the controller 100 with reference to FIG. 10. The controller 100 includes a recording control section 101, a sheet-supply control section 102, a conveyance control section 103, a housing-position judging section 104, a cap-movement control section 105, and the lock control section 106. The controller 100 includes: a central processing unit (CPU); a read only memory (ROM); a random access memory (RAM) (including a nonvolatile or nontransitory RAM); an application specific integrated circuit (ASIC); an interface (I/F); an input/output port (I/O); and so on. The ROM stores therein programs to be executed by the CPU, various fixed data, and so on. The RAM temporarily stores therein data required for the execution of the programs. The ASIC performs, e.g., rewriting and sorting of the image data. Specifically, the ASIC performs a signal processing and an image processing, for example. The I/F transmits or receives data to or from an external device such as a PC connected to the printer 1. The I/O inputs or outputs detection signals of various sensors. These components serve as various functional sections such as the recording control section 101 by cooperation of software such as the programs stored in the ROM and hardware such as the CPU with each other.

The recording control section 101 controls the heads 10 based on the image data to eject the liquid onto the sheet P. The sheet-supply control section 102 controls the drive motor for the sheet-supply roller 21 to supply an uppermost one of the sheets P accommodated in the sheet-supply tray 20 by the sheet-supply roller 21.

The conveyance control section 103 controls the conveyor mechanism 50 and the drive motor for the conveyor roller pairs to convey the sheet P along one or ones of the three conveyance paths formed in the printer 1. When the sheet is conveyed through the first conveyance path, the conveyance control section 103 controls the conveyor mechanism 50 to convey the sheet P supplied from the sheet-supply unit 1*c*, to the support portion 60 along the arrows R1, R2 in FIG. 2. The conveyance control section 103 then controls the drive motor for the conveyor roller pairs 25-28 to convey the sheet P from the support portion 60 to the sheet-discharge portion 1*e* along the arrows R2-R5.

When the sheet is conveyed through the second conveyance path, the conveyance control section 103 controls the drive motor for the conveyor roller 82 to convey the sheet manually supplied on the tray portion 81, toward the curved path R1 along the arrow U. The conveyance control section 103 then controls the drive motor for the conveyor roller pairs 23-28 to convey the sheet having entered into the downstream portion of the curved path R1, to the sheet-discharge portion 1*e* as in the case where the sheet is conveyed through the first conveyance path.

When the sheet is conveyed through the third conveyance path, the conveyance control section 103 controls the drive motor for the conveyor roller pairs 27, 28, 96, 97 to return the sheet having conveyed to the conveyor roller pair 28 along the first or second conveyance path, to the curved path R1 along the arrows T1-T3. Thereafter, the conveyance control section 103 controls the conveyor roller pairs 23-28 to discharge the sheet onto the sheet-discharge portion 1*e* as in the case where the sheet is conveyed through the first or second conveyance path.

The recording control section 101, the conveyance control section 103, and the sheet-supply control section 102 control the supply and the conveyance of the sheet P or the manually-set sheet (hereinafter simply called the sheet) and the liquid ejection from the heads 10 in synchronization with each other. In this control, the sheet is conveyed through the first or second conveyance path, and the liquid is ejected onto the sheet from the heads 10 when the sheet passes through the positions under the heads 10, whereby a desired image is formed or recorded on the sheet. The recorded sheet is discharged onto the sheet-discharge portion 1*e*. When images are formed on both of the faces of the sheet, the sheet recorded on its front face is returned to the curved path R1 along the third conveyance path and conveyed through the positions under the heads 10 again, in which the heads 10 eject the liquid to form an image. In this case, a back face of the sheet faces the heads 10. Accordingly, the image is formed on the back face of the sheet whose front face has been recorded. As a result, the sheet recorded on both faces thereof is discharged onto the sheet-discharge portion 1*e*.

The housing-position judging section 104, based on the detection signal of the housing-position sensor 121, judges whether the upper housing 1*a* is located at the ejection position. The cap-movement control section 105 controls the cap moving mechanism 41 to change the position of each cap member 40 between the sealing position and the open position. When the image is formed on the sheet, the cap-movement control section 105 controls the cap members 40 to move away from the respective facing faces 62*a*. The cap-movement control section 105 has a flag representing the position of each cap member 40 and updates this flag each time when the position of each cap member 40 is changed. Further, the cap-movement control section 105 controls the cap moving mechanism 41 based on the detection signal from the housing-position sensor 121 and the lock mechanism 70 as described below.

The lock control section 106 controls the driving of the solenoid 84. When the lock control section 106 drives the solenoid 84, the arm 841 is drawn by the solenoid 84. When the solenoid 84 does not drive the solenoid 84, the arm 841 is not drawn by the solenoid 84. When the user pushes the button, and the button sensor 86 outputs the sense signal (the limitation release signal), the lock control section 106 drives the solenoid 84. When the solenoid 84 is driven, the arm 841 is drawn by the solenoid 84, and the handle 72 is changed to the rotation allowed state shown in FIG. 4B. Thereafter, when the housing-position judging section 104 judges that the upper housing 1*a* is not located at the ejection position, the lock control section 106 stops driving the solenoid 84.

Further, the controller 100 controls the carriage moving mechanism 3*c*, the rotor pivoting mechanism 60*a*, and so on.

It is noted that, the head unit 9 and the recording control section 101 for controlling the heads 10 are one example of a recording portion. The conveyor mechanism 50 and the conveyance control section 103 for controlling this conveyor mechanism 50 are one example of a conveyor portion. The sheet-supply unit 1*c* and the sheet-supply control section 102 for controlling this sheet-supply unit 1*c* are one example of a supply portion. The lock mechanism 70 and the lock control section 106 for controlling this lock mechanism 70 are one example of a limitation portion. The housing-position sensor 121 and the housing-position judging section 104 is one example of a judging section. The cap-movement control section 105 is one example of a movement control section.

Here, when the upper housing 1*a* is pivoted from the ejection position to the distant position, the components accommodated in the upper housing 1*a* are pivoted about the pivot shaft 1*x*. For example, the head unit 9 is one of the components. Incidentally, the ejection faces 10*a* of the heads 10 are disposed at the positions lower in height than the pivot shaft 1*x* as described above. Therefore, when the upper housing 1*a* is pivoted from the ejection position to the distant position, a lower end portion of the head unit 9 is moved obliquely upward in FIG. 2 (i.e., in a direction indicated by arrow Q). Accordingly, in order to avoid a contact or an interference of the lower end portion of the head unit 9 with the components accommodated in the lower housing 1*b*, the lower end portion of the head unit 9 and the components in the lower housing 1*b* need to be disposed with a clearance (space) therebetween in the sub-scanning direction. It is noted that a clearance G which will be described below is one example of the clearance (see FIG. 8A).

As described above, there is a case where the clearance has to be formed at a boundary region between the components in the upper housing 1*a* and the components in the lower housing 1*b* in order to avoid the interference between the components in the upper housing 1*a* and the components in the lower housing 1*b*. This can be applied to a case where the components in the printer 1 are divided at a region near the curved path R1 or at the register roller pair 24 as a boundary into the components in the upper housing 1*a* and the components in the lower housing 1*b*. It is assumed that the components in the printer 1 are divided at the region near the curved path R1 into the components in the upper housing 1*a* and the components in the lower housing 1*b*. For example, if the printer 1 is divided at a region near the paper-dust removing unit 90 as a boundary, it is possible to consider that the paper-dust removing unit 90 is disposed in the upper housing 1*a*, and the conveyor roller pair 23 is disposed in the lower housing 1*b*. In this case, a clearance has to be formed between the chute member 93 and the conveyor roller pair 23 in order to prevent an interference (contact) between the chute member 93 and the conveyor roller pair 23.

However, the chute member 93 is a component for defining an outer boundary of the curved path R1. Thus, if the clearance is formed between the chute member 93 and the roller, the clearance is formed in the outer boundary of the curved path R1. When the sheet P is curved along the curved path R1, the sheet P endeavors to return from its curved state to its original state (a straight shape). Thus, if the clearance is located outside the curved path R1, the leading edge of the sheet P is easily caught or stuck in the clearance. Accordingly, it is not preferable that the components in the printer 1 are divided at the region near the paper-dust removing unit 90 as a boundary into the components in the upper housing 1*a* and the components in the lower housing 1*b*. Further, if such a boundary is provided near the paper-dust removing unit 90, when the conveyor roller pair 23 and the paper-dust removing unit 90 are moved away from each other, the removed paper dust may fall down, causing a malfunction or a stain. In view of the above, from the viewpoint of preventing the jam of the sheet P, it is not preferable that the boundary between the components in the upper housing 1*a* and the components in the lower housing 1*b* is provided at the paper-dust removing unit 90. This can also be applied to other components disposed near the curved path R1.

If the components in the printer 1 are divided at the register roller pair 24 as a boundary into the components in the upper housing 1*a* and the components in the lower housing 1*b*, it is possible to consider that the driven roller 24*a* is disposed in the upper housing 1*a*, and the drive roller 24*b* is disposed in the lower housing 1*b*. Also in this case, when the upper housing 1*a* is pivoted, the driven roller 24*a* is moved obliquely upward and leftward in FIG. 2. Thus, a clearance has to be formed between the driven roller 24*a* and a component next to the driven roller 24*a*, and this clearance may cause the jam of the sheet P. Further, the register roller pair 24 is for correcting the skew of the sheet P just before the sheet P is conveyed to the heads 10. Thus, if the driven roller 24*a* is configured to be moved away from the drive roller 24*b*, the position of the roller may not be precisely adjusted, resulting in a lower accuracy of the skew correction.

In view of the above, in the present embodiment, the components in the printer 1 are divided into the components in the upper housing 1*a* and the components in the lower housing 1*b* by a two-dot chain line B in FIG. 2 as a boundary. Since the two-dot chain line B does not extend through an area near the curved path R1, there is no need to form a clearance(s) for preventing the components near the curved path R1 from interfering with one another. That is, there is no need to form a clearance(s) near the curved path R1, which may cause the jam of the sheet P.

Specifically, the lower housing 1*b* accommodates the panel 1*d*, the conveyor roller 82, the paper-dust removing unit 90, the conveyor roller pairs 22, 23, the conveyance guides 31*a*-31*d*, and the register roller pair 24. The lower housing 1*b* accommodates both of the driven roller and the drive roller of each roller pair. The lower housing 1*b* further accommodates the support portion 60, a lower drive roller 25*b* of the conveyor roller pair 25, and so on. Meanwhile, the upper housing 1*a* accommodates the head unit 9, the conveyance guides 32*a*, the pressure roller 33, an upper driven roller 25*a* of the conveyor roller pair 25, and so on. Accordingly, when the upper housing 1*a* is moved to the distant position, these components are positioned as shown in FIG. 7. That is, as described above, when the upper housing 1*a* is pivoted about the pivot shaft 1*x* with respect to the lower housing 1*b*, the head unit 9, the conveyance guides 32*a*, and so on accommodated in the upper housing 1*a* are pivoted together with the upper housing 1*a* with respect to the lower housing 1*b*. On the other hand, as described above, when the upper housing 1*a* is pivoted about the pivot shaft 1*x* with respect to the lower housing 1*b*, the conveyor roller pairs 22, 23, the conveyance guides 31*a*-31*d*, the register roller pair 24, the sheet-supply unit 1*c*, the platen 61, and so on accommodated in the lower housing 1*b* are never pivoted together with the upper housing 1*a* and thus never moved relative to the lower housing 1*b*.

The head unit 9 and the conveyance guide 31*d* are disposed in the upper housing 1*a* and the lower housing 1*b*, respectively. Thus, as shown in FIG. 8A, the clearance G for spacing the conveyance guide 31*d* and the head unit 9 (specifically, the upstream cap member 40) apart from each other in the sub-scanning direction is formed between the conveyance guide 31*d* and the head unit 9. Here, since the clearance G is formed near the conveyance path for the sheet P, it is possible to consider that the clearance G causes the jam of the sheet P. However, as described above, the conveyance guide 31*d* guides the sheet P obliquely downward toward the support faces 61*a*. This direction is different from a direction directed from the conveyance path toward the clearance G formed on an upper side of the conveyance path. Thus, it is possible to prevent the sheet P from being caught or stuck in the clearance G.

Specifically, the clearance G is formed between a side face of the conveyance guide 31*d* and a side face of the upstream cap member 40. Since the projecting portion 31*x* projecting toward the head unit 9 is formed on the lower end portion of the conveyance guide 31*d*, the clearance G is partly narrow at a region interposed between the projecting portion 31*x* and the cap member 40 (i.e., a region indicated by arrow W in FIG. 8A). A size and a shape of the clearance G are determined or set such that the head unit 9 and the conveyance guide 31*d* do not interfere with each other in the pivotal movement of the upper housing 1*a*, on the precondition that the cap member 40 is kept at the open position (i.e., the state shown in FIG. 8A) when the upper housing 1*a* is pivoted between the ejection position and the distant position.

Figure 9A:
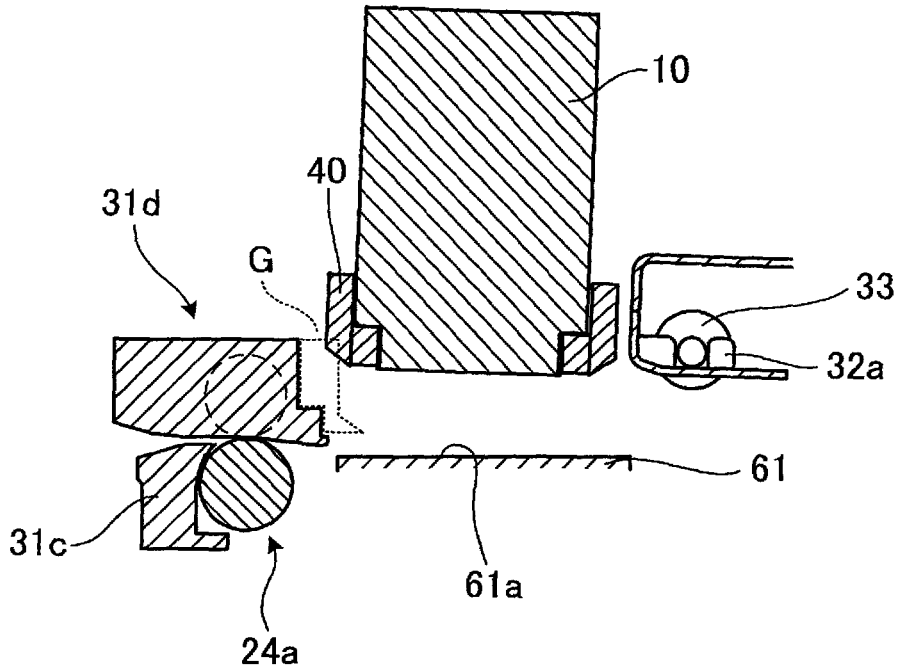
Figure 9B:
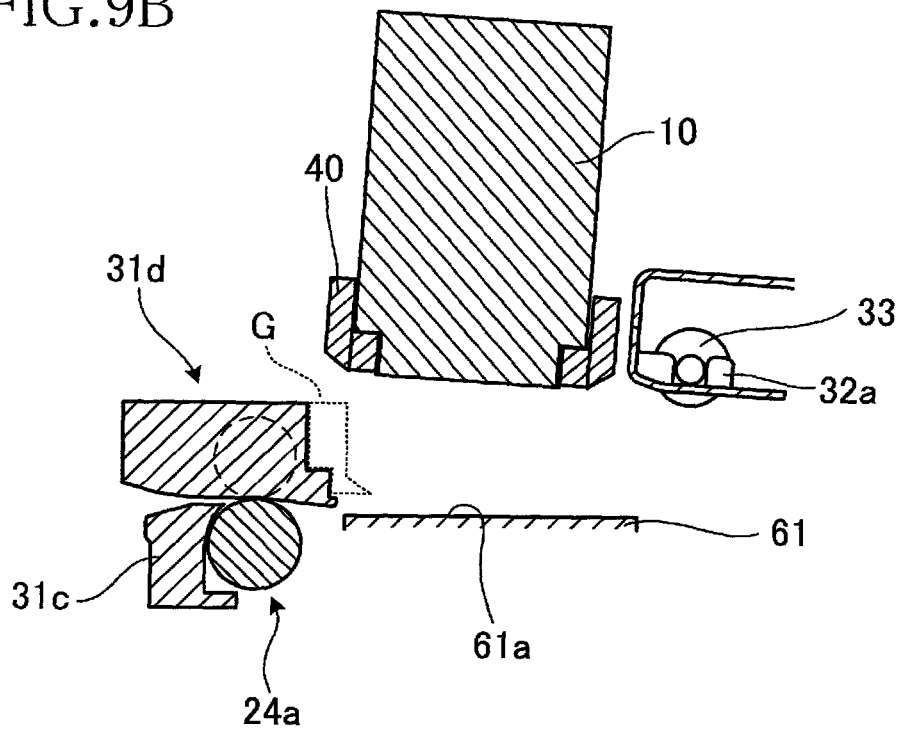

Since this clearance G is formed, when the upper housing 1*a* is pivoted from the ejection position to the distant position, the cap member 40 passes through the clearance G while being moved from its state shown in FIG. 8A to its state in FIG. 8B, then to its state in FIG. 9A, and then to its state in FIG. 9B. For example, in the state in FIG. 8B, a left end portion of the cap member 40 is located in a space (area) corresponding to the clearance G. In the state in FIG. 9A, a left lower end of the cap member 40 is located in the space corresponding to the clearance G. In the state in FIG. 9B, an entirety of the head unit 9 including the cap member 40 is completely distant from the clearance G. As thus described, a part of the head unit 9 (the upstream or left cap member 40) passes through the space corresponding to the clearance G, whereby the upstream or left head 10 can be smoothly moved without its interference with the conveyance guide 31*d*.

Incidentally, there may be a case in which the user intends to move the upper housing 1*a* when the cap member 40 is located at the sealing position. If the upper housing 1*a* is moved in the state in which the cap member 40 is located at the sealing position, there is a high possibility that the head unit 9 and the projecting portion 31*x* interfere with each other. This is because the clearance G has a relatively small width on the precondition that the upper housing 1*a* is moved in the state in which the cap member 40 in located at the open position as described above.

Figure 11:
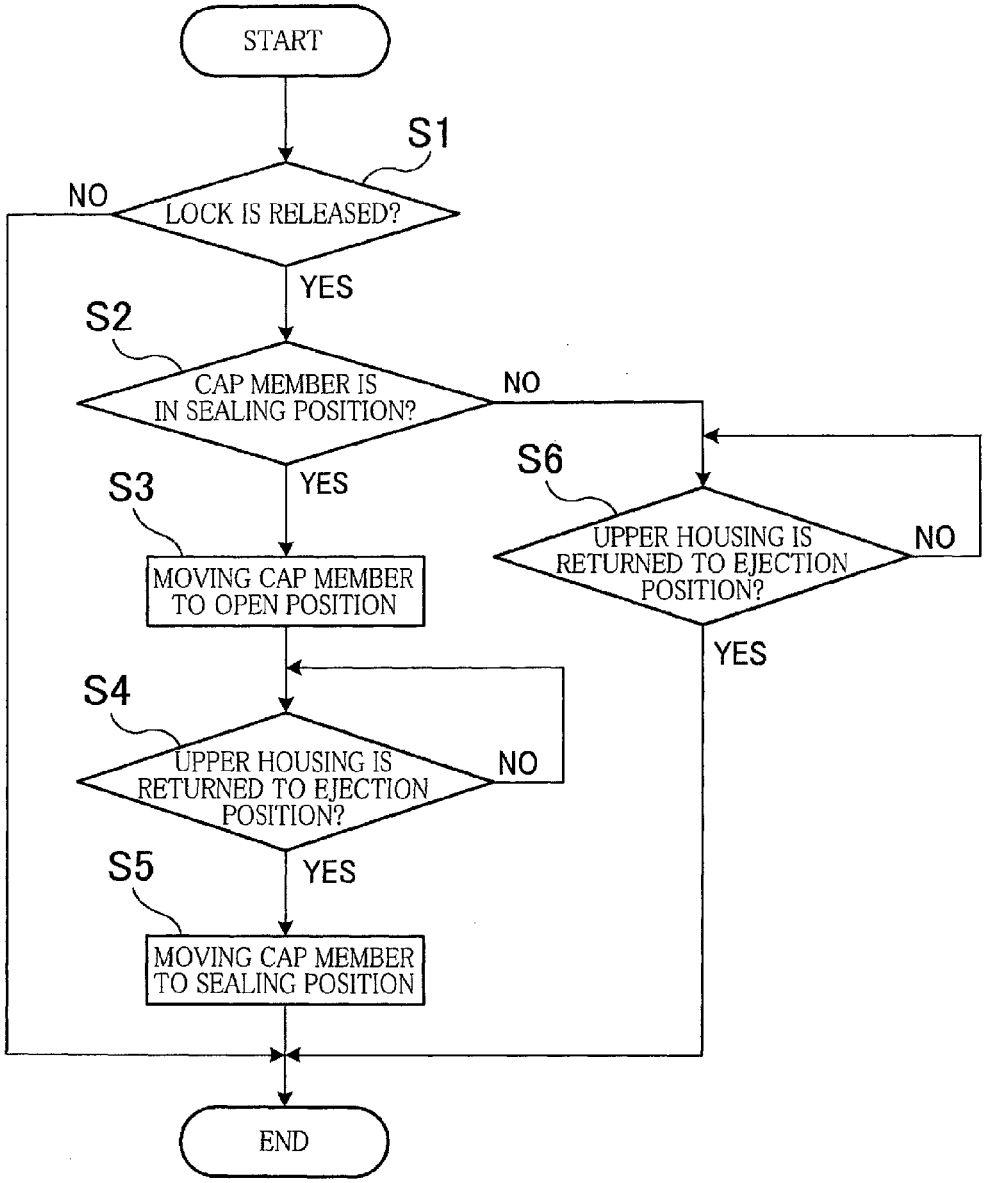
FIG. 11 is a flow-chart showing a processing for a carriage moving mechanism.

Thus, in the present embodiment, the cap-movement control section 105 controls the cap moving mechanism 41 based on the limitation release signal outputted from the lock mechanism 70 to move the cap member 40 from the sealing position to the open position. Specifically, the controller 100 executes a control flow shown in FIG. 11. Initially in S1, the lock control section 106 judges whether the limitation release signal has been outputted from the lock mechanism 70. When the lock control section 106 judges that the limitation release signal has not been outputted (S1: No), the controller 100 temporarily finishes this control. Thereafter, the lock control section 106 regularly executes the processing in S1 to check whether the limitation release signal has been outputted.

When the lock control section 106 judges that the limitation release signal has been outputted (S1: Yes), the cap-movement control section 105 in S2 judges whether the cap member 40 is located at the sealing position. The cap-movement control section 105 has the flag representing the state of the cap member 40 as described above and executes the judgment in S2 based on this flag. When the cap-movement control section 105 judges that the cap member 40 is located at the open position (S2: No), the lock control section 106 drives the solenoid 84. Thereafter, when the housing-position judging section 104 judges that the upper housing 1*a* is not located at the ejection position, the lock control section 106 stops driving the solenoid 84. After the upper housing 1*a* is moved from the ejection position, the housing-position judging section 104 in S6 judges whether the upper housing 1*a* has been returned to the ejection position. When the housing-position judging section 104 judges that the upper housing 1*a* has not been returned to the ejection position (S6: No), the cap-movement control section 105 repeats the processing in S6. That is, the cap-movement control section 105 controls the cap member 40 to be kept at the open position until the housing-position judging section 104 judges that the upper housing 1*a* has been returned to the ejection position. When the housing-position judging section 104 judges that the upper housing 1*a* has been returned to the ejection position (S6: Yes), the controller 100 finishes this control flow. As thus described, since the processing is not executed until the housing-position judging section 104 judges that the upper housing 1*a* has been returned to the ejection position, the cap member 40 can be reliably kept at the open position during this period.

When the cap-movement control section 105 in S2 judges that the cap member 40 is located at the sealing position (S2: Yes), the cap-movement control section 105 in S3 controls the cap moving mechanism 41 to move the cap member 40 to the open position. The lock control section 106 then drives the solenoid 84. Thereafter, when the housing-position judging section 104 judges that the upper housing 1*a* is not located at the ejection position, the lock control section 106 stops driving the solenoid 84. After the upper housing 1*a* is moved from the ejection position, the housing-position judging section 104 in S4 judges whether the upper housing 1*a* has been returned to the ejection position. When the housing-position judging section 104 judges that the upper housing 1*a* has not been returned to the ejection position (S4: No), the cap-movement control section 105 repeats the processing in S4. That is, the cap-movement control section 105 controls the cap member 40 to be kept at the open position until the housing-position judging section 104 judges that the upper housing 1*a* has been returned to the ejection position. When the housing-position judging section 104 judges that the upper housing 1*a* has been returned to the ejection position (S4: Yes), the cap-movement control section 105 in S5 controls the cap moving mechanism 41 to move the cap member 40 to the sealing position. As a result, when the limitation release signal is received with the cap member 40 being located at the sealing position, the limitation of the upper housing 1*a* by the lock mechanism 70 is released after the cap member 40 is moved to the open position. Thus, it is possible to reliably prevent the interference between the head unit 9 and the conveyance guide 31*d*.

In the present embodiment described above, the clearance G for preventing the interference is formed between the conveyance guide 31*d* and the head unit 9 (specifically, the upstream cap member 40). This makes it possible to prevent the conveyance guide 31*d* and the head unit 9 from interfering with each other when the upper housing 1*a* is moved. The conveyance guide 31*d* guides the sheet P in the direction in which the sheet P is moved away from the clearance G. Thus, the sheet P is guided in the direction that is different from the direction directed from the conveyance path toward the clearance G, making it difficult for the sheet P to enter into the clearance G. That is, in the present embodiment, the clearance G for preventing the interference is formed between the conveyance guide 31*d* and the head unit 9, but the conveyance guide 31*d* guides the sheet P such that the sheet P does not enter into the clearance, thereby preventing the occurrence of the jam of the sheet P.

Further, since the boundary between the upper housing 1*a* and the lower housing 1*b* is not provided near the curved path R1, there is no need to provide the clearance for preventing the interference in the middle of the U-shaped curved path R1, thereby preventing the occurrence of the jam of the sheet P. For example, since the boundary does not need to be provided near the paper-dust removing unit 90, the components of the paper-dust removing unit 90 never interfere with each other, or the paper dust never falls down when the upper housing 1*a* is pivoted. Further, the driven roller and the drive roller of each of the conveyor roller pairs 22, 23 and the register roller pair 24 are accommodated in the lower housing 1*b*. Thus, these rollers are never moved away from each other, and thereby an accuracy of the conveyance of the sheet is not lowered. In particular, the accuracy of the skew correction by the register roller pair 24 is not lowered.

The projecting portion 31*x* is provided on the one of the opposite end portions of the lower end portion of the conveyance guide 31*d*, which one is nearer to the platen 61 than the other. Thus, the clearance G is partly narrow (at the region indicated by the arrow W in FIG. 8A). When the upper housing 1*a* is moved, the head unit 9 (the cap member 40) is moved obliquely upward and leftward in FIG. 2 (i.e., in the direction indicated by arrow Q). That is, the head unit 9 is moved toward the conveyance guide 31*d* while moving upward. Accordingly, the head unit 9 is less likely to interfere or contact with the projecting portion 31*x* provided on the one of the opposite end portions of the lower end portion of the conveyance guide 31*d*, which one is nearer to the platen 61 than the other. Further, since the clearance G has the relatively small width portion, the sheet P is less likely to be caught or stuck in the clearance G. That is, since the projecting portion 31*x* is provided on the one of the opposite end portions of the lower end portion of the conveyance guide 31*d*, which one is nearer to the platen 61 than the other, the jam of the sheet P is prevented while avoiding the interference of the projecting portion 31*x* with the head unit 9.

The size and the shape of the clearance G are determined on the precondition that the upper housing 1*a* is moved in the state in which the cap member 40 in located at the open position. As a result, the width of the clearance G can be made small when compared to a case where the size and the shape of the clearance G are determined on the precondition that the upper housing 1*a* is moved in the state in which the cap member 40 is located at the sealing position. This results in a reduction in size of the printer 1.

When the lock of the lock mechanism 70 is released, the cap-movement control section 105, based on the limitation release signal and the signal from the housing-position sensor 121, reliably keeps the cap member 40 at the open position until the upper housing 1*a* is returned to the ejection position. This reliably prevents that the upper housing 1*a* is moved in the state in which the cap member 40 is located at the sealing position, and that the cap member 40 and the conveyance guide 31*d* interfere with (contact) each other.

It is noted that the pivot shaft 1*x* is disposed at the right end portion of the upper housing 1*a* in FIG. 2 in the present embodiment for the following reasons in a positional relationship between the pivotal shaft 1*x* and the sheet conveyance path. The conveyance path for the sheet P has a generally inverted S-shape in FIG. 2. Where this conveyance path is provided as in the present embodiment, an access to the sheet-discharge portion 1*e* by the user is performed from a left side thereof in FIG. 2, and the mounting or removal of the sheet-supply tray 20 is also performed from a left side thereof. Further, since the pivot shaft 1*x* is disposed at the above-described position, a left end portion of the printer 1 in FIG. 2 is opened when the upper housing 1*a* is pivoted. Thus, if the sheet P is jammed between the head 10 and the support portion 60, the user can clear the jammed sheet from a left side thereof in FIG. 2. As thus described, since the pivot shaft 1*x* is disposed at the above-described position, the access to the sheet-discharge portion 1*e*, the mounting and removal of the sheet-supply tray 20, and the clearance operation of the jammed sheet are performed from the same side of the printer 1, which improves an operability of the user.

Further, in the present embodiment, the pivot shaft 1*x* is located at the position higher than that of the ejection face 10*a*. Thus, when the upper housing 1*a* is pivoted, a right end of the upper housing 1*a* in FIG. 2 (a rear portion of the printer 1) is not moved so as to extend out rightward when compared to a case where the pivot shaft 1*x* is located at a position lower than that of the ejection face 10*a*. Accordingly, a space located on a rear (back) side of the printer 1 can be made smaller, resulting in a reduction in a space for the printer 1.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

For example, in the above-described embodiment, each rotor 63 changes the position of the corresponding platen 61 and the position of the corresponding facing member 62 therebetween. However, the platen may be fixed so as not to be switched in its position with another component. In this configuration, the fixed platen functions as both of the support member and the facing member.

In the above-described embodiment, the signal outputted by the lock mechanism 70 is the limitation release signal. However, instead of the signal from the lock mechanism 70, a signal for detecting the occurrence of the jam of the sheet P in the sheet conveyance path may be outputted to the controller 100 as the limitation release signal. Specifically, the controller 100 senses the jammed sheet based on a signal outputted from a sheet sensor that senses whether the sheet is conveyed normally, a signal outputted from the drive motor of the conveyor roller pair 22-28, or the like, for example. Where the printer 1 is configured in this manner, when the occurrence of the jam of the sheet is sensed, the controller 100 executes the processings in FIG. 11 by regarding the signal outputted from the sheet sensor or the like as the limitation release signal.

The application of the present invention is not limited to the printer, and the present invention is applicable to various liquid ejection apparatuses such as a facsimile machine and a copying machine. The head may be a head configured to eject liquid other than the ink.

What is claimed is:

1. A liquid ejection apparatus, comprising:

a recording portion including a liquid ejection head having an ejection face, the liquid ejection head being elongated in a first direction as a main scanning direction parallel to the ejection face;

a supply portion configured to supply a recording medium;

a support member configured to support the recording medium while facing the ejection face;

a conveyor mechanism including (i) a conveyance guide configured to guide the recording medium and defining a U-shaped curved path extending from the supply portion toward the support member and (ii) a conveyor roller configured to convey the recording medium along the conveyance guide, the conveyor mechanism being configured to convey the recording medium in a second direction as a sub-scanning direction parallel to the ejection face and perpendicular to the main scanning direction;

a first housing accommodating the recording portion; and a second housing accommodating the supply portion, the support member, and the conveyor mechanism, wherein the first housing is pivotable about a pivot shaft extending along the main scanning direction, between (i) an ejection position at which the recording portion ejects liquid onto the recording medium supported by the support member and (ii) a distant position at which the recording portion is farther from the support member than the recording portion in a situation in which the first housing is located at the ejection position, wherein, when the first housing is located at the ejection position, the pivot shaft is located at a position that is farther from the support member than the ejection face in a third direction as a vertical direction perpendicular to the ejection face and that is downstream of the recording portion in the sub-scanning direction, wherein the recording portion is configured to move along an arc containing a component of the sub-scanning direction, while the first housing is pivoted about the pivot shaft, wherein the conveyance guide includes a guide portion disposed downstream of the conveyor roller and upstream of the recording portion in the sub-scanning direction, the guide portion having a guide face inclined obliquely downward toward a downstream side of the guide face in the sub-scanning direction, the guide portion being configured to guide the recording medium along the guide face, wherein a downstream end of the guide face is located at a position lower than an upstream end of the guide face in the vertical direction, wherein the downstream end of the guide face is disposed upstream of the recording portion, and is located at a position lower than the ejection face and higher than the support member in the vertical direction, wherein, when the first housing is located at the ejection position, the guide portion is opposed to the recording portion in the sub-scanning direction with a clearance therebetween, wherein the recording portion is configured to pass through a space corresponding to the clearance when the first housing is pivoted between the ejection position and the distant position, wherein the recording portion further includes an annular member enclosing the ejection face, and wherein the liquid ejection apparatus further comprises:

a facing member allowed to face the ejection face;

a moving mechanism configured to move the annular member in the vertical direction such that the annular member is selectively positioned at one of (i) a sealing position at which the annular member is held in contact with a facing face of the facing member to seal the ejection face and (ii) an open position at which the annular member is distant from the facing member;

a limitation portion configured to limit the pivotal movement of the first housing located at the ejection position;

a sensor configured to output a limitation release signal indicating a release of the limitation by the limitation portion; and a movement control section configured to control the moving mechanism to move the annular member to the open position when the limitation release signal outputted from the sensor is received.

2. The liquid ejection apparatus according to claim 1, wherein the guide portion includes a nearest end, and when the first housing is located at the ejection position, the nearest end of the guide face which is the nearest to the support member in the vertical direction among portions of the guide face is located at a position nearer to the support member in the vertical direction than an end portion of the recording portion which is the nearest to the support member in the vertical direction among portions of the recording portion.

3. The liquid ejection apparatus according to claim 1, wherein the guide portion includes an end portion that is a downstream end portion of the guide portion in the sub-scanning direction and that is a part of one of opposite end portions of the guide portion, which one is nearer to the support member than the other of the opposite end portions in the vertical direction, the end portion projecting toward a downstream side thereof in the sub-scanning direction.

4. The liquid ejection apparatus according to claim 1, wherein the annular member is disposed along a side face of the liquid ejection head, the side face extending in the vertical direction, and wherein, when the first housing is located at the ejection position, the guide portion is opposed directly to the annular member in the sub-scanning direction with the clearance interposed therebetween.

5. The liquid ejection apparatus according to claim 1, wherein the open position is a position at which the annular member is farther from the facing face in the vertical direction than the guide portion when the first housing is located at the ejection position.

6. The liquid ejection apparatus according to claim 1, wherein the second housing further accommodates a driven roller rotatable by the rotation of the conveyor roller in a state in which the recording medium is nipped between the driven roller and the conveyor roller.

7. The liquid ejection apparatus according to claim 1, wherein the second housing further accommodates a foreign-matter remover configured to remove foreign matters on the recording medium and disposed downstream of the supply portion and upstream of the conveyor roller in the U-shaped curved path.

8. A liquid ejection apparatus, comprising:

a recording portion including a liquid ejection head having an ejection face, the liquid ejection head being elongated in a first direction parallel to the ejection face;

a supply portion configured to supply a recording medium;

a support member configured to support the recording medium while facing the ejection face;

a conveyor mechanism including (i) a conveyance guide configured to guide the recording medium and defining a U-shaped curved path extending from the supply portion toward the support member and (ii) a conveyor roller configured to convey the recording medium along the conveyance guide, the conveyor mechanism being configured to convey the recording medium in a second direction parallel to the ejection face and perpendicular to the first direction;

a first housing accommodating the recording portion; and a second housing accommodating the supply portion, the support member, and the conveyor mechanism, wherein the first housing is pivotable about a pivot shaft extending along the first direction, between (i) an ejection position at which the recording portion ejects liquid onto the recording medium supported by the support member and (ii) a distant position at which the recording portion is farther from the support member than the recording portion in a situation in which the first housing is located at the ejection position, wherein, when the first housing is located at the ejection position, the pivot shaft is located at a position that is farther from the support member than the ejection face in a third direction perpendicular to the ejection face and that is downstream of the recording portion in the second direction, wherein the conveyance guide includes a guide portion disposed downstream of the conveyor roller and upstream of the recording portion in the second direction, the guide portion having a guide face inclined in a direction directed from the ejection face toward the support member in the third direction toward a downstream side of the guide face in the second direction, the guide portion being configured to guide the recording medium along the guide face, wherein, when the first housing is located at the ejection position, the guide portion is opposed to the recording portion in the second direction with a clearance therebetween, and wherein the recording portion is configured to pass through a space corresponding to the clearance when the first housing is pivoted between the ejection position and the distant position, wherein the recording portion further includes an annular member enclosing the ejection face, wherein the liquid ejection apparatus further comprises:

a facing member allowed to face the ejection face;

a moving mechanism configured to move the annular member in the third direction such that the annular member is selectively positioned at one of (i) a sealing position at which the annular member is held in contact with a facing face of the facing member to seal the ejection face and (ii) an open position at which the annular member is distant from the facing member;

a limitation portion configured to limit the pivotal movement of the first housing located at the ejection position;

a sensor configured to output a limitation release signal indicating a release of the limitation by the limitation portion; and a movement control section configured to control the moving mechanism to move the annular member to the open position when the limitation release signal outputted from the sensor is received, and wherein the guide portion includes a nearest end, and when the first housing is located at the ejection position, and the annular member is located at the open position, the nearest end of the guide face which is the nearest to the support member in the third direction among portions of the guide face is located at a position nearer to the support member in the third direction than an end portion of the annular member which is the nearest to the support member in the third direction among portions of the annular member.

9. The liquid ejection apparatus according to claim 8, wherein the guide portion includes an end portion that is a downstream end portion of the guide portion in the second direction and that is a part of one of opposite end portions of the guide portion, which one is nearer to the support member than the other of the opposite end portions in the third direction, the end portion projecting toward a downstream side thereof in the second direction.

10. The liquid ejection apparatus according to claim 8, wherein the annular member is disposed along a side face of the liquid ejection head, the side face extending in the third direction, and wherein, when the first housing is located at the ejection position, the guide portion is opposed directly to the annular member in the second direction with the clearance interposed therebetween.

11. The liquid ejection apparatus according to claim 8, wherein the open position is a position at which the annular member is farther from the facing face in the third direction than the guide portion when the first housing is located at the ejection position.

12. The liquid ejection apparatus according to claim 8, wherein the second housing further accommodates a driven roller rotatable by the rotation of the conveyor roller in a state in which the recording medium is nipped between the driven roller and the conveyor roller.

13. The liquid ejection apparatus according to claim 8, wherein the second housing further accommodates a foreign-matter remover configured to remove foreign matters on the recording medium and disposed downstream of the supply portion and upstream of the conveyor roller in the U-shaped curved path.

14. A liquid ejection apparatus, comprising:

a recording portion including a liquid ejection head having an ejection face, the liquid ejection head being elongated in a first direction parallel to the ejection face;

a supply portion configured to supply a recording medium;

a support member configured to support the recording medium while facing the ejection face;

a conveyor mechanism including (i) a conveyance guide configured to guide the recording medium and defining a U-shaped curved path extending from the supply portion toward the support member and (ii) a conveyor roller configured to convey the recording medium along the conveyance guide, the conveyor mechanism being configured to convey the recording medium in a second direction parallel to the ejection face and perpendicular to the first direction;

a first housing accommodating the recording portion; and a second housing accommodating the supply portion, the support member, and the conveyor mechanism, wherein the first housing is pivotable about a pivot shaft extending along the first direction, between (i) an ejection position at which the recording portion ejects liquid onto the recording medium supported by the support member and (ii) a distant position at which the recording portion is farther from the support member than the recording portion in a situation in which the first housing is located at the ejection position, wherein, when the first housing is located at the ejection position, the pivot shaft is located at a position that is farther from the support member than the ejection face in a third direction perpendicular to the ejection face and that is downstream of the recording portion in the second direction, wherein the conveyance guide includes a guide portion disposed downstream of the conveyor roller and upstream of the recording portion in the second direction, the guide portion having a guide face inclined in a direction directed from the ejection face toward the support member in the third direction toward a downstream side of the guide face in the second direction, the guide portion being configured to guide the recording medium along the guide face, wherein, when the first housing is located at the ejection position, the guide portion is opposed to the recording portion in the second direction with a clearance therebetween, wherein the recording portion is configured to pass through a space corresponding to the clearance when the first housing is pivoted between the ejection position and the distant position, wherein the recording portion further includes an annular member enclosing the ejection face, wherein the liquid ejection apparatus further comprises:

a facing member allowed to face the ejection face;

a moving mechanism configured to move the annular member in the third direction such that the annular member is selectively positioned at one of (i) a sealing position at which the annular member is held in contact with a facing face of the facing member to seal the ejection face and (ii) an open position at which the annular member is distant from the facing member;

a limitation portion configured to limit the pivotal movement of the first housing located at the ejection position;

a sensor configured to output a limitation release signal indicating a release of the limitation by the limitation portion;

a movement control section configured to control the moving mechanism to move the annular member to the open position when the limitation release signal outputted from the sensor is received; and a judging section configured to judge whether the first housing is located at the ejection position, wherein, when the limitation release signal outputted from the sensor is received, the movement control section controls the moving mechanism to have the annular member be located at the open position until the judging section judges that the first housing is located at the ejection position after the judging section judges that the first housing is not located at the ejection position.

15. The liquid ejection apparatus according to claim 14, wherein the guide portion includes an end portion that is a downstream end portion of the guide portion in the second direction and that is a part of one of opposite end portions of the guide portion, which one is nearer to the support member than the other of the opposite end portions in the third direction, the end portion projecting toward a downstream side thereof in the second direction.

16. The liquid ejection apparatus according to claim 14, wherein the annular member is disposed along a side face of the liquid ejection head, the side face extending in the third direction, and wherein, when the first housing is located at the ejection position, the guide portion is opposed directly to the annular member in the second direction with the clearance interposed therebetween.

17. The liquid ejection apparatus according to claim 14, wherein the open position is a position at which the annular member is farther from the facing face in the third direction than the guide portion when the first housing is located at the ejection position.

18. The liquid ejection apparatus according to claim 14, wherein the second housing further accommodates a driven roller rotatable by the rotation of the conveyor roller in a state in which the recording medium is nipped between the driven roller and the conveyor roller.

19. The liquid ejection apparatus according to claim 14, wherein the second housing further accommodates a foreign-matter remover configured to remove foreign matters on the recording medium and disposed downstream of the supply portion and upstream of the conveyor roller in the U-shaped curved path.

* * * * *